US008745776B2

(12) United States Patent
Mizuno et al.

(10) Patent No.: US 8,745,776 B2
(45) Date of Patent: Jun. 10, 2014

(54) AUTOMATIC HEAD CARE APPARATUS AND AUTOMATIC HEAD CARE METHOD

(75) Inventors: Osamu Mizuno, Osaka (JP); Soichiro Fujioka, Osaka (JP); Tohru Nakamura, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/819,387

(22) PCT Filed: Apr. 20, 2012

(86) PCT No.: PCT/JP2012/002762
§ 371 (c)(1),
(2), (4) Date: Feb. 27, 2013

(87) PCT Pub. No.: WO2012/147321
PCT Pub. Date: Nov. 1, 2012

(65) Prior Publication Data

US 2013/0152300 A1 Jun. 20, 2013

(30) Foreign Application Priority Data

Apr. 25, 2011 (JP) ..... 2011-096801

(51) Int. Cl.
*A45D 19/10* (2006.01)

(52) U.S. Cl.
USPC ..... 4/519

(58) Field of Classification Search
USPC ..... 4/515–523
See application file for complete search history.

(56) References Cited

U.S. PATENT DOCUMENTS 3,575,181 A 4/1971 Rudd
3,603,320 A 9/1971 Scipione
(Continued)

FOREIGN PATENT DOCUMENTS

JP 6-21636 U 3/1994
JP 6-078821 A 3/1994
(Continued)

OTHER PUBLICATIONS

Supplementary European Search Report for corresponding European Application No. 12777691.2 mailed Nov. 7, 2013.
(Continued)

*Primary Examiner* — Lori Baker
(74) *Attorney, Agent, or Firm* — Renner, Otto, Boisselle & Sklar, LLP

(57) ABSTRACT

An object of the present invention is to care for the occipital region supported with an occipital region supporter, without leaving an uncared-for part thereof, at time of automatic care of the person's head. In order to achieve the object, an automatic head washing apparatus 11 according to the present invention, is an automatic head care apparatus that cares for a person's head automatically, which has a first end effector 13 and a second end effector 16, and which is controlled by a plurality of modes including: a first mode for rubbing a second region 24 of the occipital region 22 by moving the second end effector 16 in a state in which the first end effector 13 contacts a first region 23 of the occipital region 22 of the person with the first end effector 13 being fixed at a first position; and a second mode for rubbing a first region 23 of the occipital region 22 by moving the first end effector 13 in a state in which the second end effector 16 contacts a second region 24 of the occipital region 22 with the second end effector 16 being fixed at a second position.

17 Claims, 17 Drawing Sheets

(56) References Cited

U.S. PATENT DOCUMENTS

| | | | | |
|---|---|---|---|---|
| 2002/0050005 | A1 | 5/2002 | Shimizu | |
| 2004/0127822 | A1 | 7/2004 | Eisenberg | |
| 2013/0145540 | A1* | 6/2013 | Mizuno et al. | 4/518 |
| 2013/0152299 | A1* | 6/2013 | Mizuno et al. | 4/517 |
| 2013/0160198 | A1* | 6/2013 | Mizuno et al. | 4/517 |
| 2013/0160786 | A1* | 6/2013 | Fujioka et al. | 132/200 |

FOREIGN PATENT DOCUMENTS

| | | | |
|---|---|---|---|
| JP | 07-236511 | A | 9/1995 |
| JP | 2002-136331 | A | 5/2002 |
| JP | 2003-245119 | A | 9/2003 |
| JP | 2006-181039 | A | 7/2006 |
| JP | 2010-178979 | A | 8/2010 |

OTHER PUBLICATIONS

International Search Report for corresponding International Application No. PCT/JP2012/002762 issued Oct. 29, 2013.

International Search Report for corresponding International Application No. PCT/JP2012/002762 mailed Jul. 24, 2012.

Form PCT/ISA/237 for corresponding International Application No. PCT/JP2012/002762 dated Jul. 24, 2012.

* cited by examiner

AUTOMATIC HEAD CARE APPARATUS AND AUTOMATIC HEAD CARE METHOD

FIELD OF THE INVENTION

The present invention relates to an automatic head care apparatus for supporting the occipital region of a person's head and automatically caring the same, for use in a medicare or hairdressing and beauty industry.

BACKGROUND OF THE INVENTION

A hair washing has been known as one of the typical person's head cares. In the hairdressing and beauty industry, the laborious head and/or hair washing has been desired to be automated. Also in the medicare industry, the laborious hair washing services for the inpatients have been expected to be automated.

JP 2002-136331 (A) discloses an automatic hair washing apparatus which washes a person's head with hot water by jetting the hot water to the head.

FIGS. 15A and 15B are explanatory views for explaining an automatic hair washing apparatus according to prior art disclosed in JP 2002-136331 (A). FIG. 15A is a cross-sectional view of the automatic hair washing apparatus at the time of hair washing, and FIG. 15B is the cross-sectional view of the automatic hair washing apparatus at the time of washing the occipital region of the head.

As shown in FIG. 15A, the automatic hair washing apparatus has a hair washing basin 1 into which the person's head is inserted, has shower nozzles 2, mounted on an inner wall of the hair washing basin 1, for jetting water, etc., on the hair of the occipital and temporal regions of the person's head, has an overhead shower nozzle 3 for jetting water, etc., on the hair of the frontal region thereof, and has an occipital region supporter 4.

When the occipital region of the head is washed by the automatic hair washing apparatus, the occipital region supporter 4, having supported the occipital region of the person's head, is tilted down, and then the occipital region thereof with which the occipital region supporter 4 has contacted is washed manually whilst a user or an operator, of the apparatus supports the person's head by hand.

In accordance with the automatic hair washing apparatus as shown in FIGS. 15A and 15B, the hair washing is performed by the hot water, etc., being jetted on the person's head from the shower nozzles 2, in a state that the occipital region of the person's head is put on the occipital region supporter 4. With this apparatus, because the hair on the person's head can be washed automatically, its manual labor can be saved.

Disadvantageously, in the conventional automatic hair washing apparatus as shown in FIGS. 15A and 15B, the occipital region of the person's head is supported on the occipital region supporter 4, and the part of the head which contacts the supporter 4, can not be washed by the jetting of water. Therefore, as shown in FIG. 15B, it is necessary to manually wash the occipital region which contacts the occipital region supporter 4, whilst the user of the apparatus supports the person's head by his/her own hand. The weight of a person's head is about 5 kg, and to support the person's head by hand at the time of washing the occipital region of the head becomes a physically big burden on the user. Here, in order to reduce the user's burden, if the occipital region thereof is washed manually in a state that the occipital region is supported on the occipital region supporter 4, then the part of the head which has been supported on the supporter 4 remains unwashed.

The present invention is to solve such a problem of hair washing, and provide an automatic head care apparatus or an automatic head care method for automatically caring a part of the occipital region, which is supported on the occipital region supporter.

SUMMARY OF THE INVENTION

In order to achieve the above object, there is provided an automatic head care apparatus for caring a person's head automatically, which comprises a first contact unit; a second contact unit; a first driving unit for driving the first contact unit; a second driving unit for driving the second contact unit; and a control unit for controlling the first driving unit and the second driving unit, wherein the control unit controls the first driving unit and the second driving unit in a plurality of modes, including: a first mode for rubbing a second region of an occipital region by moving the second contact unit in a state in which the first contact unit contacts a first region of the occipital region of the person with the first contact unit being fixed at a first position; and a second mode for rubbing the first region of the occipital region by moving the first contact unit in a state in which the second contact unit contacts the second region of the occipital region with the second contact unit being fixed at a second position.

Moreover, there is provided an automatic head care method for caring a person's head automatically, which cares the person's head in a plurality of modes, including: a first mode for rubbing a second region of an occipital region by moving a second contact unit in a state in which a first contact unit contacts a first region of the occipital region of the person with the first contact unit being fixed at a first position; and a second mode for rubbing the first region of the occipital region by moving the first contact unit in a state in which the second contact unit contacts the second region of the occipital region with the second contact unit being fixed at a second position.

As aforementioned, the automatic head care apparatus, or the automatic head care method, according to the present invention, makes it possible to automatically care a part of the occipital region, which is supported by the occipital region supporter.

DESCRIPTION OF THE EMBODIMENTS

Figure 1A:
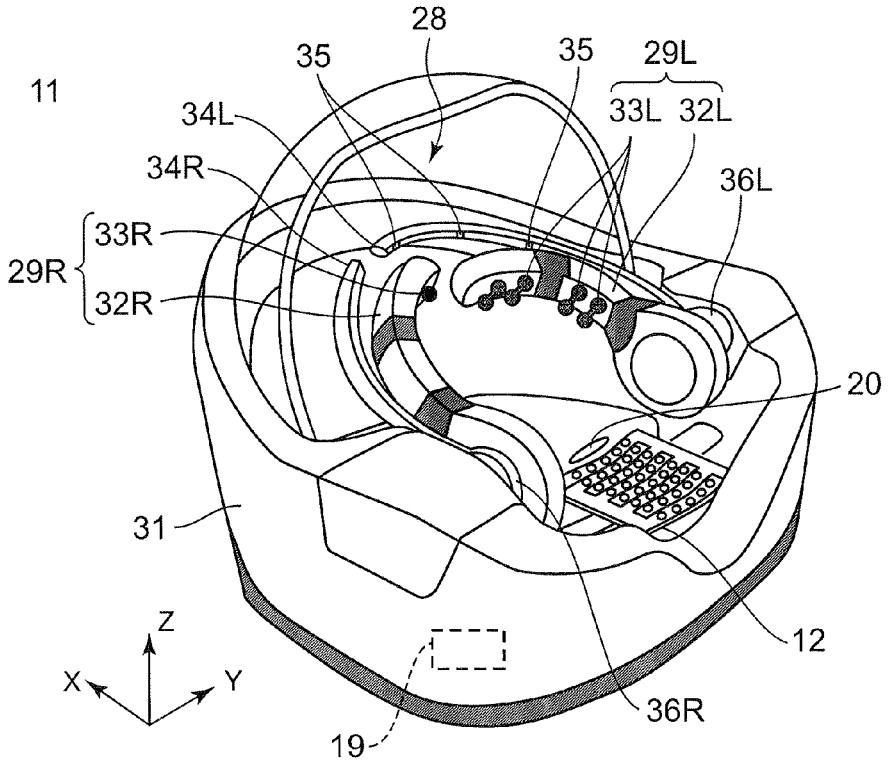
FIG. 1A is a perspective view showing an automatic head washing apparatus according to a first embodiment of the present invention, which has an occipital region supporter.

With reference to the accompanying drawings, several embodiments according to the invention will be described hereinafter. Like elements are denoted by like reference numerals to avoid duplicate descriptions. Also, each drawing mainly shows structural element or elements schematically for the better understanding thereof. Further, the drawings indicate X-axes, Y-axes and Z-axes for clarifying relations amongst the drawings.

In the present specification, the term "water" is used in a broader sense including "hot water". In other words, the term "water" in the present specification means "water or hot water". In the present specification, the term "hot water" is used in a narrower sense including only "hot water".

An automatic head washing apparatus for washing a person's head automatically is explained below, as an example of an automatic head care apparatus for caring the person's head automatically. Also, an automatic head washing method for washing a person's head automatically is explained below, as an example of an automatic head care method for caring the person's head automatically. It should be noted that "head care" includes washing person's scalp and hair and massaging person's head throughout the application.

First Embodiment

FIG. 1A is a perspective view showing an automatic head washing apparatus 11 according to a first embodiment of the present invention. As shown in FIG. 1A, the automatic head washing apparatus 11 has a bowl 31 for accommodating a person's head 21 (refer to FIG. 1B), an occipital region supporter 12 for supporting the occipital region 22, accommodated inside the bowl 31, of the person's head 21, and a control unit 19 for controlling the automatic head washing apparatus 11. The bowl 31 is an example of container unit for the person whose head is washed by the automatic head washing apparatus 11.

The bowl 31 is constructed so as to wrap around a side of the occipital region of the head 21 of the person who is in a state of looking up. In a state that the person's head 21 is in correct position relative to the bowl 31, a direction of a body axis of the head 21 is arranged along a direction of X-axis, a direction of right-and-left of the head 21 is arranged along a direction of Y-axis, and a direction of front-and-back of the head 21 is arranged along a direction of Z-axis.

The occipital region supporter 12 is mounted on the bowl 31. The occipital region supporter 12 supports the occipital region 22 from its vertical underside in the bowl 31. The detailed construction of the occipital region supporter 12, is explained later.

Adjacent to the occipital region supporter 12, a nozzle 20 is mounted on the bottom surface of the bowl 31. The nozzle 20 jets, or spouts, liquid like water, washing solution, conditioner, etc., toward the occipital region 22. The nozzle 20 is connected to a liquid supply unit 30 for supplying liquid thereto for washing the head (refer to FIG. 1B). The liquid supply unit 30 supplies at least one of water, washing solution like shampoo, etc., and a conditioner, as liquid for washing. The liquid supplied to the nozzle 20 from the liquid supply unit 30, is jetted toward the occipital region 22 through the nozzle 20. In the first embodiment, a combination of the jet of the liquid and the movement, or operation, of the occipital region supporter 12 explained later, enables the occipital region 22 to be washed and rinsed.

Also, the automatic head washing apparatus 11 has a washing unit 28 for washing the head 21.

The washing unit 28 are comprised of a pair of end effectors 29L, 29R, and a pair of pipes 34L, 34R having a plurality of nozzles 35.

The end effector 29L is for rubbing a left half of the head 21 which is supported on the occipital region supporter 12, and the end effector 29R is for rubbing a right half of the head 21. The end effector 29L has a swing arm 32L which can rotate about a rotating shaft 36L which extends in the direction of Y-axis, and it has a plurality of contacts 33L mounted on the swing arm 32L. The end effector 29R has a swing arm 32R which can rotate about a rotating shaft 36R which extends in the direction of Y-axis, and it has a plurality of contacts 33R mounted on the swing arm 32R.

The swing arms 32L, 32R rotate about the rotating shafts 36L, 36R, so that the arms 32L, 32R swing around in the direction of front-and-back of the head 21. Also, the swing arms 32L, 32R can rotate about (unshown) shafts which extend in a direction different from the direction of the rotating shafts 36L, 36R. Thereby, the swing arms 32L, 32R can push-rotate in a direction in which the swing arms 32L, 32R move closer to and away from the head 21.

The contacts 33L, 33R can move so as to knead the head 21 in a state of contacting the head 21.

The pipe 34L is coupled to the rotating shaft 36L, and it swings around together with the swing arm 32L. The pipe 34R is coupled to the rotating shaft 36R, and it swings around together with the swing arm 32R. On the basis of control signals from the control unit 19, liquid like water, washing solution, conditioner, etc., is supplied to the pipes 34L, 34R from the liquid supply unit 30. The liquid supplied from the liquid supply unit 30 to the pipes 34L, 34R, is jetted towards the head 21 through the nozzles 35.

An example of automatic washing operation by the washing unit 28, is explained. It is to be noted that the washing unit 28 can perform various operations other than the operation explained below.

The automatic washing of the head 21 by the washing unit 28 is performed in a state in which the occipital region 22 is supported on the occipital region supporter 12. Firstly, water is jetted towards the head 21 from the nozzles 35, thereby washing the head 21 with the water. Next, in order to wash the head 21, the washing solution is jetted towards the head 21 from the nozzles 35, whilst the swing arms 32L, 32R are swung about the rotating shafts 36L, 36R. By combining the swinging operation or movement of the swing arms 32L, 32R, with the push-rotating operation or movement of the swing arms 32L, 32R against the head 21 and with the rotating operation or movement of the plurality of contacts 33L, 33R, the head 21 is washed, or cleaned, by rubbing.

Here, at the time of the automatic washing by the washing unit 28, a part of the occipital region 22 which is supported on the occipital region supporter 12, can not be washed. However, the occipital region supporter 12 according to the first embodiment, has a function to wash the occipital region 22, as explained later. Therefore, the occipital region supporter 12 of the automatic head washing apparatus 11, according to the first embodiment, can prevent a part of the head 21 from being unwashed.

The construction of the occipital region supporter 12 is explained below.

Figure 1B:
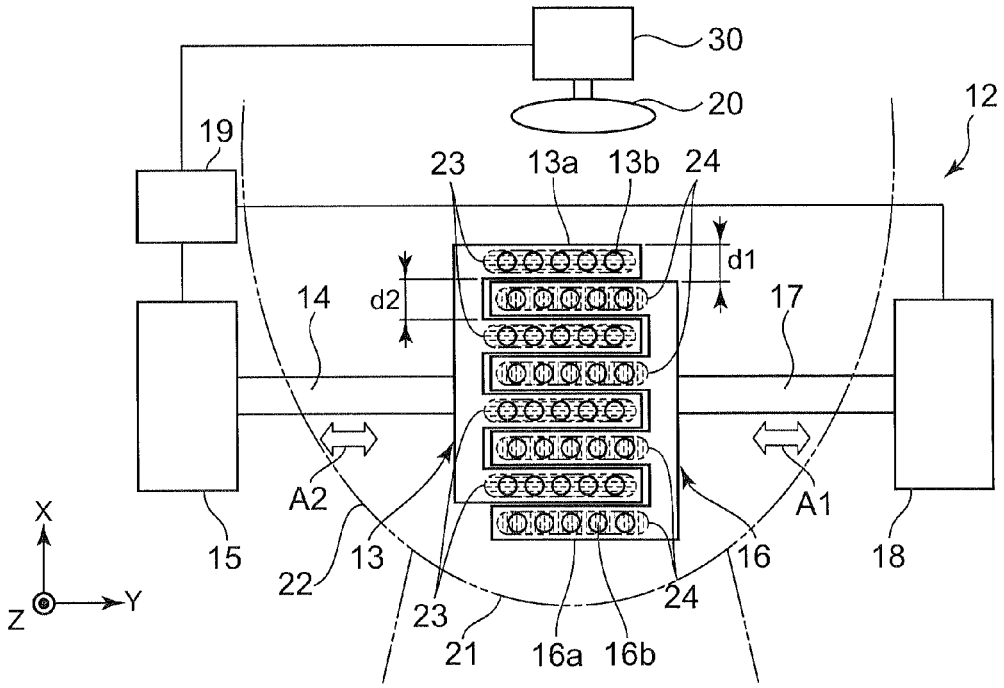
FIG. 1B is a schematic view of the occipital region supporter according to the first embodiment.

FIG. 1B is a schematic view of the occipital region supporter 12. As shown in the FIG. 1B, the occipital region supporter 12 has a first end effector 13, a first driving unit 15 which is coupled to the first end effector 13 via a first arm piece 14, a second end effector 16, and a second driving unit 18 which is coupled to the second end effector 16 via a second arm piece 17. By the way, FIG. 1B shows the first driving unit 15 and the second driving unit 18, in a simplified manner, and a concrete example of the mechanism of the first driving unit 15 and the second driving unit 18, is explained later.

The first end effector 13 has a plurality of support plates 13*a* which extend leftward of the head 21 (i.e. rightward in FIG. 1B), in which the support plates 13*a* are branched, or forked, like a comb. The number of the support plates 13*a* is, for example, four. The first end effector 13 is an example of a first contact unit (a first washing unit), and it can contact a first region 23 of the occipital region 22 supported on the occipital region supporter 12.

The width d1, in the direction of narrowness, of the support plate 13*a* is uniform over the entire length. Also, all the support plates 13*a* have the equal width d1, respectively. The width d1 of the support plate 13*a* is smaller than the width d2 of spacing between adjacent support plates 13*a*.

The second end effector 16 has a plurality of support plates 16*a* which extend rightward of the head 21 (i.e. leftward in FIG. 1B), in which the support plates 16*a* are branched, or forked, like a comb. The number of the support plates 16*a* is, for example, four. The second end effector 16 is an example of a second contact unit (a second washing unit), and it can contact a second region 24 of the occipital region 22 supported on the occipital region supporter 12.

The width, in the direction of narrowness, of the support plate 16*a* is uniform over the entire length. Also, the width of the support plate 16*a* is the same as the width d1 of the support plates 13*a*. The width of spacing between adjacent support plates 16*a* is equal to the width d2, and it is larger than the width d1 of the support plate 16*a*.

In the occipital region supporter 12 according to the first embodiment, the support plate 13*a* of the first end effector 13, and the support plate 16*a* of the second end effector 16, are arranged alternately in the direction of the X-axis. As aforementioned, the width d1 of each of the support plate 13*a* and the support plate 16*a*, is smaller than the width d2 of each of spacing between the support plates 13*a* and spacing between the support plates 16*a*. Therefore, the support plate 13*a* and the support plate 16*a*, do not interfere with each other.

The support plates 13*a*, 16*a* are made of, for example, rigid plastic, polypropylene, or vinyl chloride.

On top of the support plates 13*a*, a plurality of contacts 13*b* are fixed. On top of the support plates 16*a*, a plurality of contacts 16*b* are fixed. On each of the support plates 13*a*, 16*a*, for example, five contacts 13*b*, 16*b* per plate are arranged in position in the longitudinal direction thereof.

As the contacts 13*b*, 16*b*, for example, hemispherical elastic members made of rubber, plastic, etc., can be employed.

Here, a position at which the first end effector 13 is fixed in a state in which the first end effector 13 contacts the first region 23 of the occipital region 22, is defined as "a first position". Also, a position at which the second end effector 16 is fixed in a state in which the second end effector 13 contacts the second region 24 of the occipital region 22, is defined as "a second position".

FIG. 1B shows a state where the first end effector 13 is located at the first position, and where the second end effector 16 is located at the second position. According to the first embodiment, in a state where the head 21 is properly set in the bowl 31 and where the head 21 is properly put on the occipital region supporter 12, both the first end effector 13 at the first position and the second end effector 16 at the second position, contact a central part of the head 21.

The first driving unit 15 drives the first end effector 13 in accordance with control signals transmitted from the control unit 19, and the second driving unit 18 drives the second end effector 16 in accordance with control signals transmitted from the control unit 19. A concrete example of the first driving unit 15 and the second driving unit 18, is explained later.

The control unit 19 sets a first mode, a second mode and a third mode, as modes of operations of the first end effector 13 and the second end effector 16. The first mode, the second mode and the third mode, are the modes which set the operations for washing or supporting the head 21.

Figure 2A:
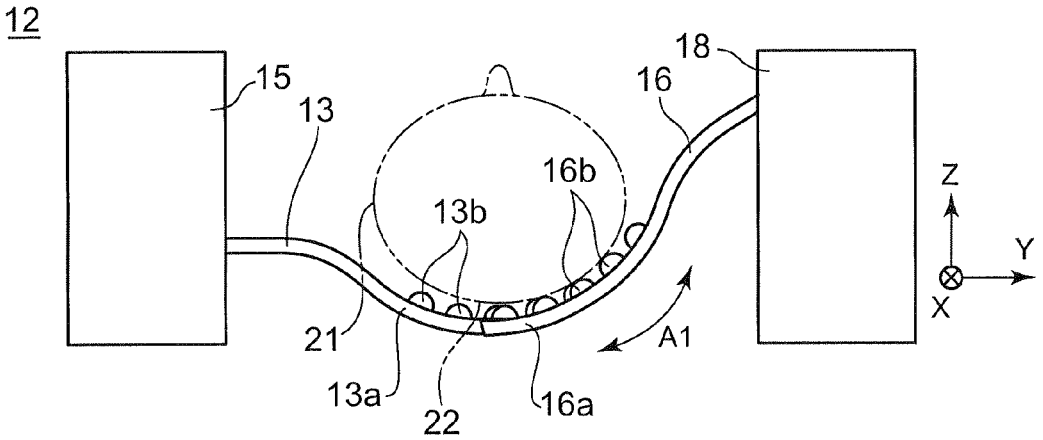
FIG. 2A is a schematic front view for explaining an operation in a first mode of the occipital region supporter according to the first embodiment.
Figure 2B:
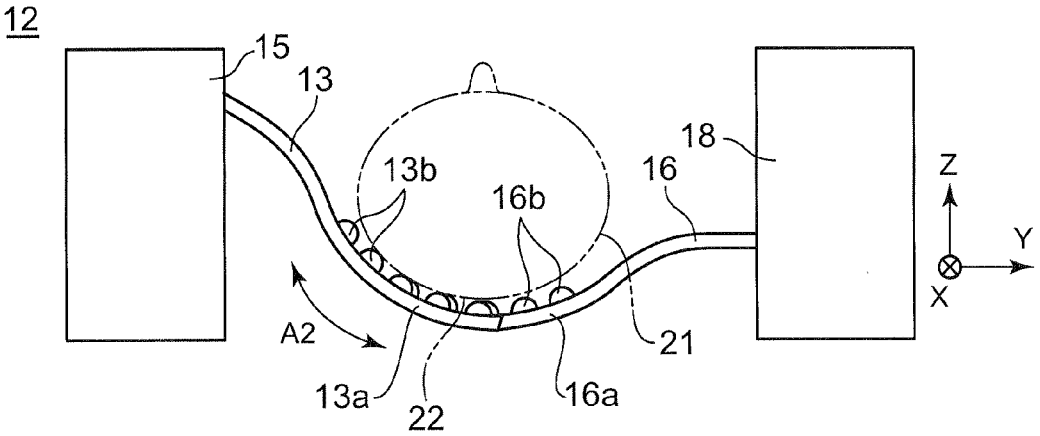
FIG. 2B is a schematic front view for explaining an operation in a second mode of the occipital region supporter according to the first embodiment.
Figure 2C:
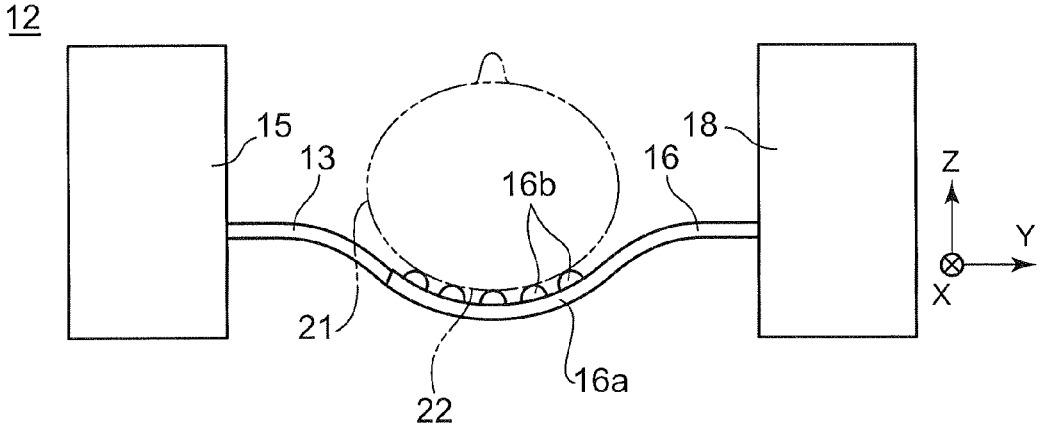
FIG. 2C is a schematic front view for explaining an operation in a third mode of the occipital region supporter according to the first embodiment.

FIGS. 2A, 2B and 2C are drawings for explaining the operations of the occipital region supporter 12 according to the first embodiment. FIG. 2A is a schematic front view of the occipital region supporter 12 in the first mode, FIG. 2B is a schematic front view of the occipital region supporter 12 in the second mode, and FIG. 2C is a schematic front view of the occipital region supporter 12 in the third mode. In the FIGS. 2A, 2B and 2C, the first driving unit 15 and the second driving unit 18 are shown in a simplified manner.

With reference to FIGS. 2A, 2B and 2C, the operation, or movement, of the occipital region supporter 12 is explained.

The washing of the occipital region 22 by the occipital region supporter 12, is performed by the operations in the first and second modes. Firstly, the control in the first and second modes, is explained.

As shown in FIG. 2A, in the first mode, the control unit 19 controls the first driving unit 15 so that the first end effector 13 is fixed at the first position. At this time, the first end effector 13 contacts the first region 23 of the occipital region 22, thereby supporting the head 21. Also, in the first mode, the control unit 19 controls the second driving unit 18 so as to swing the second end effector 16 in the direction A1 shown by an arrow, whilst supporting the head 21 by the first end effector 13. Thereby, the second end effector 16 swings along the second region 24 of the occipital region 22, and the second region 24 thereof is rubbed by the contacts 16*b* of the second end effector 16. Thereby, it is possible to wash the second region 24 of the occipital region 22 by rubbing, or to knead the same region 24, by the second end effector 16.

In the first mode, the control unit 19 can control the liquid supply unit 30 so as to jet water or washing solution from the nozzle 20 towards the occipital region 22. In this case, the washing or rinsing of the second region 24 of the occipital region 22 can be realized, by combining the jetting of the water or washing solution from the nozzle 20 with the operation, or movement, of the second end effector 16.

Also, in the first mode, the control unit 19 can control the second driving unit 18 so that the swinging movement of the second end effector 16 in the direction A1 shown by the arrow, is combined with a movement of shaking of the same effector 16 in the direction of the X-axis. Thereby, the second region 24 of the occipital region 22 can be rubbed by the second end effector 16 more effectively. By the way, it is preferable that the frequency of shaking, or vibration, of the second end effector 16 in the direction of the X-axis, is equal to or more than 20 Hz, and is equal to or less than 100 Hz (i.e. between 20 Hz and 100 Hz).

As shown in FIG. 2B, in the second mode, the control unit 19 controls the second driving unit 18 so as to fix the second end effector 16 at the second position. At this time, the second end effector 16 contacts the second region 24 of the occipital region 22, and it supports the head 21. Also, in the second mode, the control unit 19 controls the first driving unit 15 so as to swing the first end effector 13 in the direction A2 shown by the arrow whilst supporting the head 21 on the second end effector 16. Thereby, the first end effector 13 swings along the first region 23 of the occipital region 22, and the first region 23 thereof is rubbed by the contacts 13*b* of the first end effector 13. Thereby, it is possible to wash the first region 23 of the occipital region 22 by rubbing, or to knead the same region 23, by the first end effector 13.

In the second mode, the control unit 19 can also control the liquid supply unit 30 so as to jet water or washing solution from the nozzle 20 towards the occipital region 22. In this case, the washing or rinsing of the first region 23 of the occipital region 22 can be realized, by combining the jetting of the water or washing solution from the nozzle 20 with the operation, or movement, of the first end effector 13.

Also, in the second mode, the control unit 19 can control the first driving unit 15 so that the swinging movement of the first end effector 13 in the direction A2 shown by the arrow, is combined with a movement of shaking of the same effector 13 in the direction of the X-axis. Thereby, the first region 23 of the occipital region 22 can be rubbed by the first end effector 13 more effectively. By the way, it is preferable that the frequency of shaking, or vibration, of the first end effector 13 in the direction of the X-axis, is equal to or more than 20 Hz, and is equal to or less than 100 Hz (i.e. between 20 Hz and 100 Hz).

The control unit 19 switches role, or function, between the role, or function, of the first end effector 13 and the role, or function, of the second end effector 16, so as not to be overlapped with each other, by switching mode between the first mode and the second mode. Thereby, the occipital region supporter 12 according to the first embodiment, can automatically wash the first region 23 and the second region 24 of the occipital region 22, which are also regions supported by the occipital region supporter 12, so as not to leave unwashed part thereof.

When the washing unit 28 washes parts other than the occipital region 22 in the head 21 automatically, the control unit 19 controls the occipital region supporter 12 in the third mode.

As shown in FIG. 2C, in the third mode, the control unit 19 controls the first driving unit 15 so that the first end effector 13 is fixed at the first position, and the control unit 19 controls the second driving unit 18 so that the second end effector 16 is fixed at the second position.

Thus, when the occipital region 22 is washed automatically by neither the first end effector 13, nor the second end effector 16, the occipital region 22 is supported by both the first end effector 13 and the second end effector 16, by which the head 21 can be supported stably.

In the embodiment, the first position and the second position are set so that the height of the occipital region 22 supported on the first end effector 13 at the first position and the height of the occipital region 22 supported on the second end effector 16 at the second position are equal to each other in the direction of the Z-axis.

Here, a case in which the height of the occipital region 22 supported on the first end effector 13 and the height of the occipital region 22 supported on the second end effector 16 are different from each other, is reviewed. In this case, when the mode of operation, or operational mode, is switched between the first mode and the second mode, the position of the head 21 is moved or shifted, and this movement or shift may give the user a feeling of anxiety. Also, in this case, because, in the third mode, the occipital region 22 is supported on both the first end effector 13 and the second end effector 16 which have different heights, the condition in which the head 21 is supported becomes unstable, which in turn may give the user a feeling of anxiety.

Also, at least one of the first driving unit 15 and the second driving unit 18 can be constructed so that the first end effector 13 or the second end effector 16 is moved in the direction of getting close to and away from the occipital region 22. With this construction, the operation, or movement, of tapping or patting the occipital region 22 can be realized by the first end effector 13 or the second end effector 16.

The operation, or movement, of tapping or patting the occipital region 22 by the first end effector 13 or the second end effector 16, is explained with reference to FIGS. 3A and 3B.

Figure 3A:
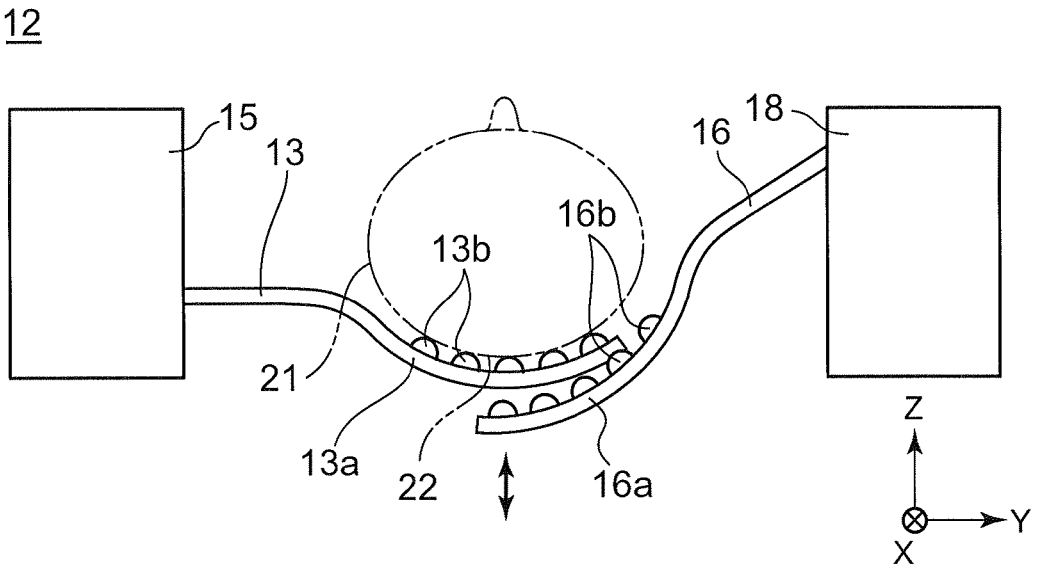
FIG. 3A is a schematic front view for explaining another operation in the first mode of the occipital region supporter according to the first embodiment.
Figure 3B:
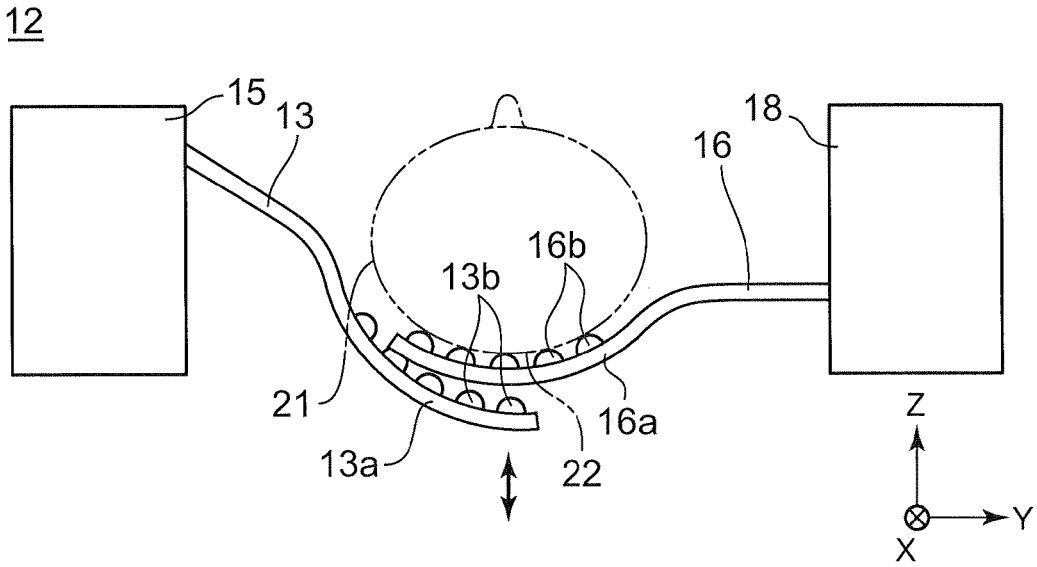
FIG. 3B is a schematic front view for explaining another operation in the second mode of the occipital region supporter according to the first embodiment.

FIGS. 3A and 3B are views for explaining another operation of the occipital region supporter 12 according to the first embodiment. FIG. 3A is a schematic front view of the occipital region supporter 12 in the first mode, and FIG. 3B is a schematic front view of the occipital region supporter 12 in the second mode. By the way, FIGS. 3A and 3B are schematic views in which the first driving unit 15 and the second driving unit 18 are simplified.

As shown in FIG. 3A, the second driving unit 18 can reciprocate the second end effector 16 in the direction of the Z-axis so that the second end effector 16 alternately repeats a condition in which it contacts the occipital region 22 and a condition in which it is away from the occipital region 22. Thereby, the operation, or movement, of tapping or patting the second region 24 of the occipital region 22 can be realized by the second end effector 16. At this time, the control unit 19 controls it so as to fix the first end effector 13 at the first position, thereby supporting the head 21 on the first end effector 13.

Also, as shown in FIG. 3B, the first driving unit 15 can reciprocate the first end effector 13 in the direction of the Z-axis so that the first end effector 13 alternately repeats a condition in which it contacts the occipital region 22 and a condition in which it is away from the occipital region 22. Thereby, the operation, or movement, of tapping or patting the first region 23 of the occipital region 22 can be realized by the first end effector 13. At this time, the control unit 19 controls it so as to fix the second end effector 16 at the second position, thereby supporting the head 21 on the second end effector 16.

Such an operation, or movement, of tapping or patting the occipital region 22 by the first end effector 13 or the second end effector 16, is useful for washing the occipital region 22, and such an operation, or movement, thereof, also has an effect of massaging the occipital region 22.

At the time of washing the occipital region 22 by the occipital region supporter 12 automatically, the aforementioned operation, or movement, of the first end effector 13 or the second end effector 16 along the occipital region 22, as shown in FIG. 2A or 2B, and the operation, or movement, of tapping or patting the occipital region 22 by the first end effector 13 or the second end effector 16, as shown in FIG. 3A or 3B, can be executed in sequence.

Also, the operation, or movement, of the first end effector 13 or the second end effector 16 along the occipital region 22, as shown in FIG. 2A or 2B, and the operation, or movement, of tapping or patting the occipital region 22 by the first end effector 13 or the second end effector 16, as shown in FIG. 3A or 3B, can be executed simultaneously. In this case, the first end effector 13 or the second end effector 16 moves elliptically, thereby realizing the operation, or movement, of tapping or patting the occipital region 22 whilst rubbing the same region 22.

Figure 4A:
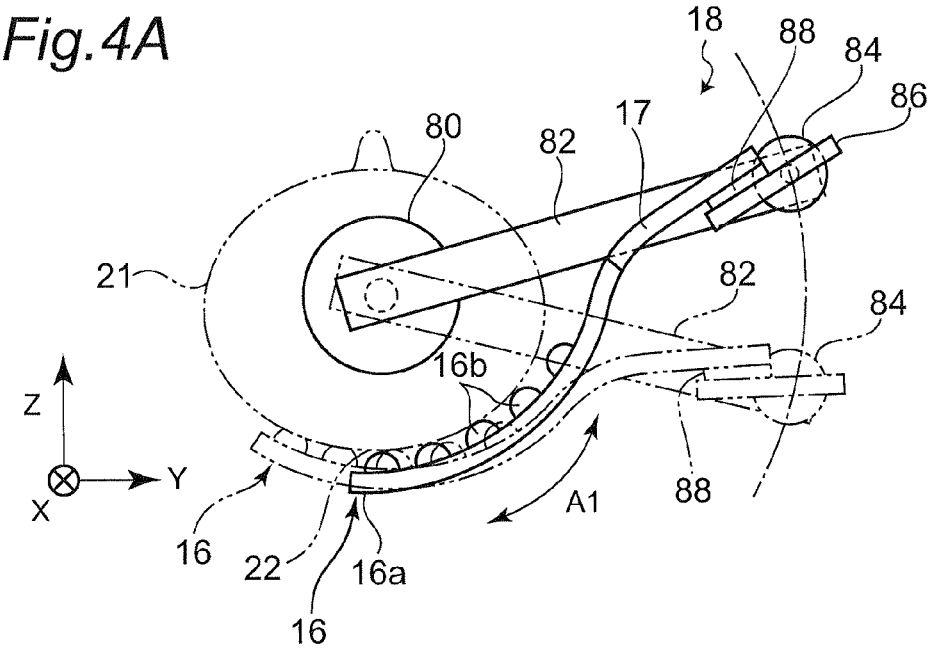
FIG. 4A is a front view showing an example of a specific mechanism of a second driving unit according to the first embodiment.
Figure 4B:
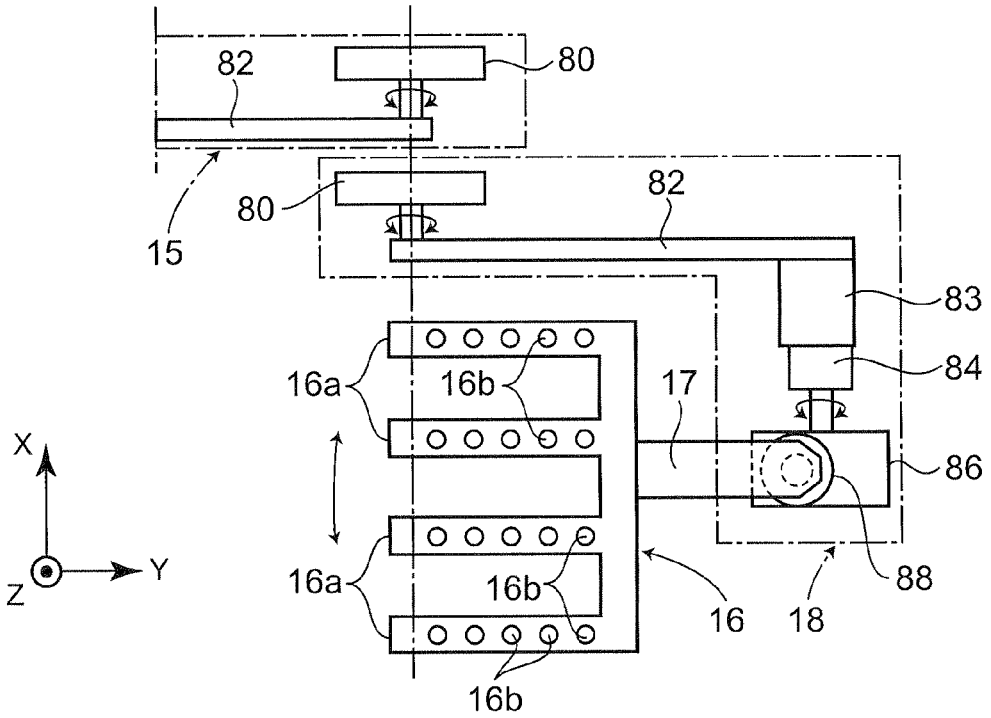
FIG. 4B is a plan view of the mechanism shown in FIG. 4A.
Figure 4C:
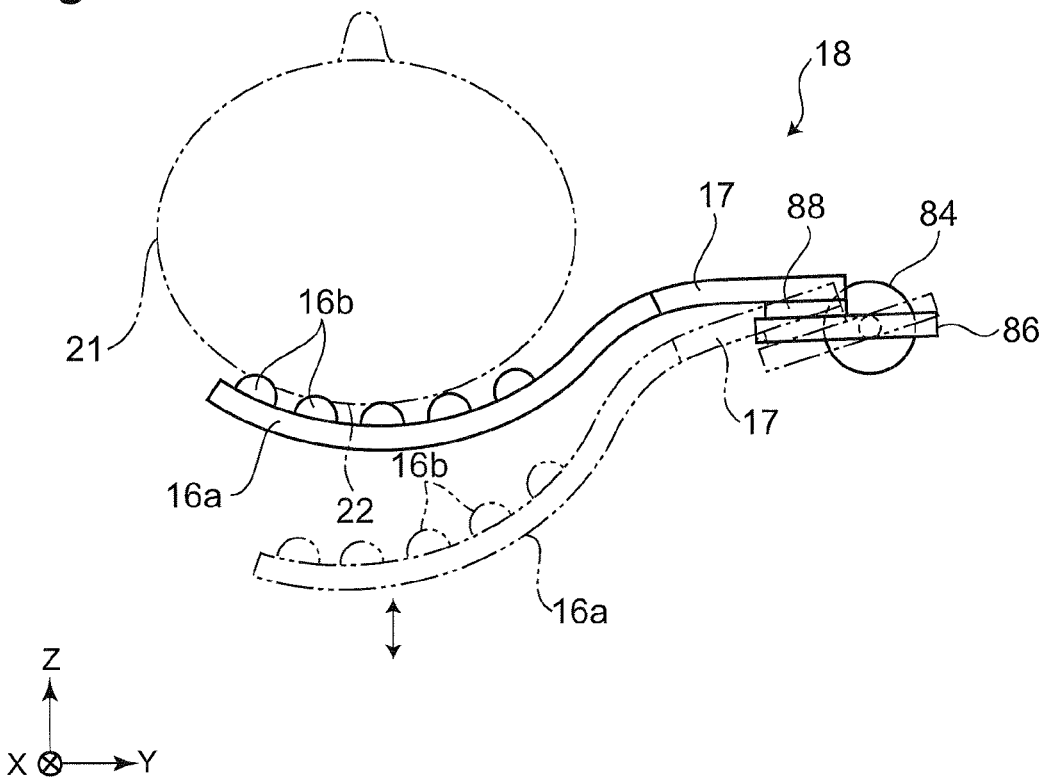
FIG. 4C is a front view showing another operation of the mechanism shown in FIG. 4A.

FIG. 4A is a front view showing an example of a specific mechanism of the second driving unit 18 according to the first embodiment. FIG. 4B is a plan view of the mechanism shown in FIG. 4A, and FIG. 4C is a front view showing another operation of the mechanism shown in FIG. 4A.

Because the first driving unit 15 adopts a mechanism similar to that of the second driving unit 18, the explanation thereof is omitted.

As shown in FIGS. 4A and 4B, the second driving unit 18 has a motor 80 for swinging the second end effector 16 in the direction A1, a motor 84 for moving the second end effector 16 as if it taps, or pats, the occipital region 22, and a motor 88 for shaking, or vibrating, the second end effector 16 in the direction which is generally parallel to the direction of the X-axis.

The motor 80 for swing is arranged at a location generally corresponding to a central part of the head 21 in the direction of the Y-axis, with its output shaft is orientated in the direction of the X-axis. The output shaft of the motor 80 for swing, is connected to one end of an coupling arm 82. The other end of the coupling arm 82 is connected to the motor 84 for tapping, via a support member 83. By the way, in a case where the first driving unit 15 has a mechanism similar to that of the second driving unit 18, an output shaft of the motor 80 for swing in the first driving unit 15, is arranged coaxially with respect to the output shaft of the motor 80 for swing in the second driving unit 18, as shown in FIG. 4B.

The motor 84 for tapping is arranged with its output shaft being orientated in the direction of the X-axis. The output shaft of the motor 84 for tapping is maintained in such a condition that the output shaft is always orientated in the direction of the X-axis, even though the motor 84 for tapping is moved by the rotation of the motor 80 for swing.

The output shaft of the motor 84 for tapping, is connected to the motor 88 for vibration, via a support member 86. The motor 88 for vibration is fixed to the support member 86 so that its output shaft is positioned in a plane perpendicular to the direction of the X-axis. The output shaft of the motor 88 for vibration is maintained in such a condition that the output shaft is always orientated in the plane perpendicular to the direction of the X-axis, even though the position and/or direction of the motor 88 for vibration is/are changed by the rotation of the motor 80 for swing and the rotation of the motor 84 for tapping. The output shaft of the motor 88 for vibration, is connected to a base end part of the second arm piece 17.

It is desirable to provide each of the motor 80 for swing, the motor 84 for tapping, and the motor 88 for vibration, with an encoder. By providing each of the motors with the encoder, the control unit 19 can detect positions of the first end effector 13 and the second end effector 16, on the basis of the output value from the encoder.

With the above construction, when the motor 80 for swing is actuated, or driven, in accordance with instructions from the control unit 19, the whole components or constitutional members starting with the coupling arm 82 and ending with the second end effector 16, swing around about the rotating shaft of the motor 80 for swing, as shown in FIG. 4A. Thereby, the second end effector 16 can be swung around in the direction A1 shown by an arrow.

Also, when the motor 84 for tapping is actuated, or driven, in accordance with instructions from the control unit 19, the whole constitutional members starting with the support member 86 and ending with the second end effector 16, swing around about the rotating shaft of the motor 84 for tapping, as shown in FIG. 4C. Thereby, the second end effector 16 can move up and down in the direction generally parallel to the direction of the Z-axis, so as to tap the occipital region 22.

Also, when the motor 88 for vibration is actuated, or driven, in accordance with instructions from the control unit 19, the second arm piece 17 and the second end effector 16 swing around about the rotating shaft of the motor 88 for vibration, as shown in FIG. 4B. Thereby, the second end effector 16 can vibrate, or shake, in the direction generally parallel to the direction of the X-axis.

The control unit 19 executes a lock control for stopping the movement, or operation, of the first end effector 13 and the second end effector 16, when the distance, or spacing, between the first end effector 13 and the second end effector 16 becomes smaller than a predetermined distance, or spacing therebetween, at the time of swinging the first end effector 13 or the second end effector 16 in the direction of A2 or A1 (refer to FIG. 2B). Thereby, collision between the first end effector 13 and the second end effector 16, can be avoided. The distance, or spacing, between the first end effector 13 and the second end effector 16, can be calculated on the basis of information on positions, or locations, of the first end effector 13 and the second end effector 16, detected by the encoder, for example.

The constitutional members of the first driving unit 15 and the second driving unit 18, are housed inside a housing of the bowl 31.

The mechanism of the first driving unit 15 and the second driving unit 18 according to the first embodiment, is merely an example, and it is also possible to adopt another mechanism.

Figure 5A:
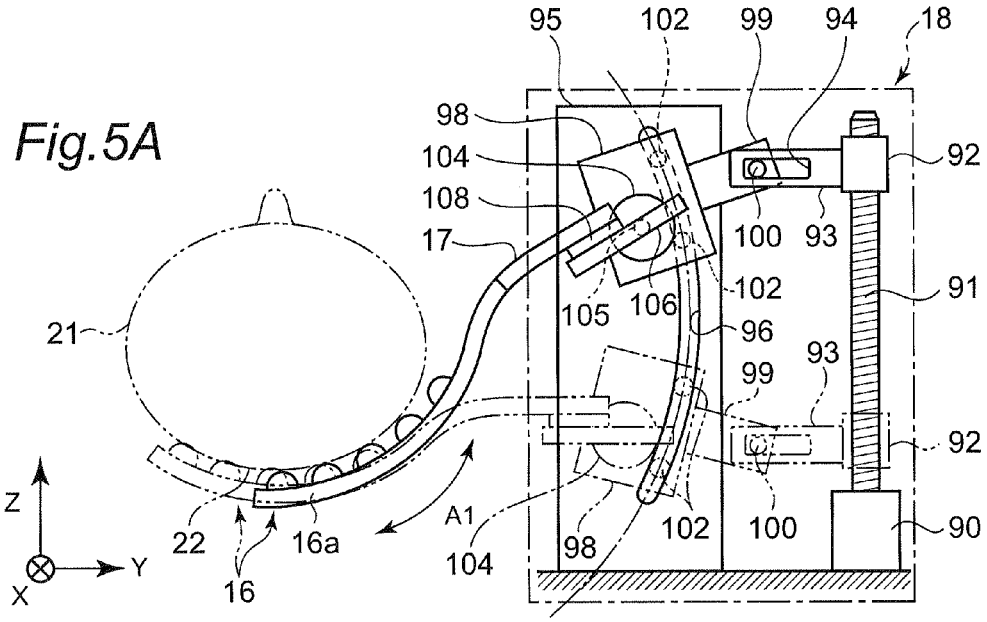
FIG. 5A is a front view showing another example of the specific mechanism of the second driving unit according to the first embodiment.
Figure 5B:
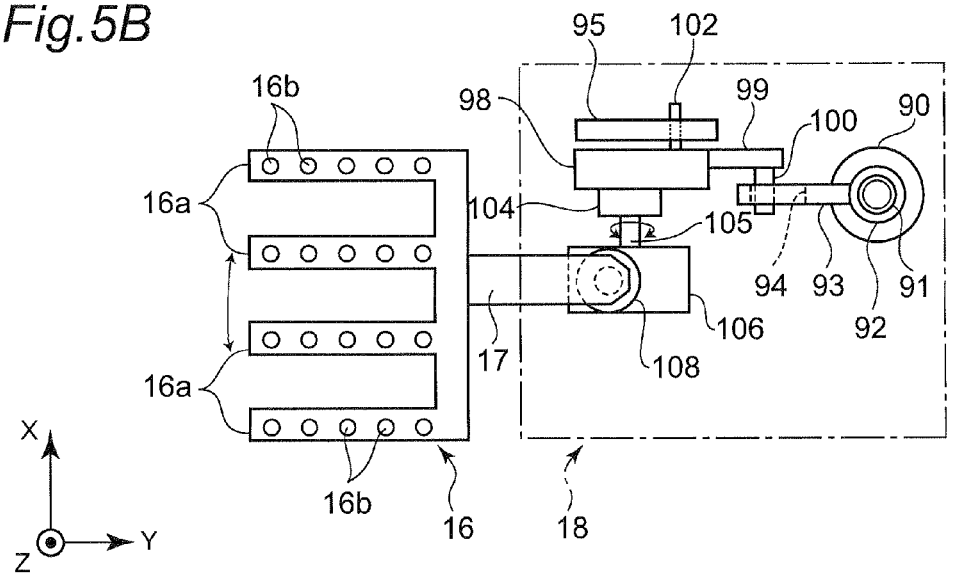
FIG. 5B is a plan view of the mechanism shown in FIG. 5A.

FIG. 5A is a front view showing another example of a specific mechanism of the second driving unit 18 according to the first embodiment, and FIG. 5B is a plan view of the mechanism shown in FIG. 5A.

Because the first driving unit 15 adopts a mechanism similar to that of the second driving unit 18, the explanation thereof is omitted.

When the mechanism shown in FIGS. 5A and 5B is adopted, the second driving unit 18 has a motor 90 for swinging the second end effector 16 in the direction A1, a motor 104 for moving the second end effector 16 so as to tap or pat the occipital region 22, and a motor 108 for vibrating the second end effector 16 in the direction generally parallel to the direction of the X-axis.

Similar to the mechanism shown in FIG. 4A, the motor 108 for vibration is fixed to a support member 106, with its output axis, or shaft, being arranged in a plane perpendicular to the direction of the X-axis. The output shaft of the motor 108 for vibration is maintained in such a condition that the output shaft thereof is always arranged in a plane perpendicular to the direction of the X-axis, even though the position and/or direction of the motor 108 for vibration is changed by the rotation of the motor 90 for swing and the rotation of the motor 104 for tapping. The output shaft of the motor 108 for vibration, is connected to a base part of the second arm piece 17.

Similar to the mechanism shown in FIG. 4A, the motor 104 for tapping is fixed to a support member 98, with its output shaft 105 being arranged in the direction of the X-axis. The output shaft of the motor 104 for tapping, is maintained in such a state that the output shaft thereof is always arranged in the direction of the X-axis, even though the motor 104 for tapping is moved by the rotation of the motor 90 for swing. The output shaft 105 of the motor 104 for tapping is connected to a support member 106 for supporting the motor 108 for vibration.

On the support member 98 for supporting the motor 104 for tapping, a plurality of cam followers 102 projecting in the direction of the X-axis, are mounted on a side opposite the motor 104 for tapping. The cam follower 102 engages a cam groove 96 in the cam plate 95 which is arranged in a plane perpendicular to the direction of the X-axis. The cam groove 96 is formed as an arc shape with a center point which is adjacent to a central part of the head 21, when viewed in the direction of the X-axis.

A pin 100, extending in the direction of the X-axis, is connected to the support member 98 which supports the motor 104 for tapping, via a coupling member 99.

The motor 90 for swing is arranged with its output shaft orientating in the direction of the Z-axis. A screw 91 which rotates integrally with the output shaft of the motor 90 for swing, is coupled to the output shaft of the motor 90 for swing. The screw 91 is mounted in the direction of the Z-axis.

A nut 92 is screwed, or threadably mounted, on the screw 91. A coupling member 93, extending in the direction of the Y-axis, is connected to an outer peripheral surface of the nut 92.

In the coupling member 93, there is arranged an elongate hole 94 in the direction of the Y-axis, in which the elongate hole 94 engages the pin 100. With the engagement of the pin 100 with the elongate hole 94, the support member 98 for supporting the motor 104 for tapping is connected to the nut 92, through a pair of the coupling members 93, 99.

It is desirable to provide each of the motor 90 for swing, the motor 104 for tapping, and the motor 108 for vibration, with an encoder. By providing each of the motors with the encoder, the control unit 19 can detect position of the second end effector 16, on the basis of the output value from the encoder.

With the above construction, when the motor 90 for swing is actuated, or driven, on the basis of instructions by the control unit 19, the nut 92 and the coupling member 93 are moved integrally up and down in the direction of the Z-axis, along with rotation of the screw 91, as shown in FIG. 5A. As aforementioned, the nut 92 is connected to the support member 98 through the coupling members 93, 99. Therefore, when the nut 92 is moved up and down by the rotation of the motor 90 for swing, the support member 98 is also moved up and down together with the nut 92. At this time, the cam followers 102 mounted on the support member 98 with the cam followers 102 protruding or projecting from the support member 98, are moved so as to draw an circular orbit, or track, along the cam groove 96. As a result, direction, or orientation, of the whole constitutional members starting with the support member 98 and ending with the second end effector 16, is changed. Thereby, the second end effector 16 can swing in the direction A1 whilst the second end effector 16 maintains a condition in which it is positioned along the occipital region 22.

When the motor 104 for tapping is actuated, or driven, on the basis of instructions by the control unit 19, the whole constitutional members starting with the support member 106 and ending with the second end effector 16, are swung around about the rotating shaft of the motor 104 for tapping, like the operation, or movement, of the example of the mechanism shown in the FIG. 4C as aforementioned.

When the motor 108 for vibration is actuated, or driven, on the basis of instructions by the control unit 19, the second arm piece 17 and the second end effector 16 are swung around about the rotating shaft of the motor 108 for vibration, as shown in FIG. 5B. Thereby, the second end effector 16 can be vibrated generally in the direction of the X-axis.

The mechanism of each of the first driving unit 15 and the second driving unit 18, is not limited to the aforementioned mechanism. For example, as to the mechanism for vibrating the first end effector 13 or the second end effector 16 in the direction of the X-axis, it is possible to employ piezoelectric elements in place of the above motors 88, 108.

Figure 6:
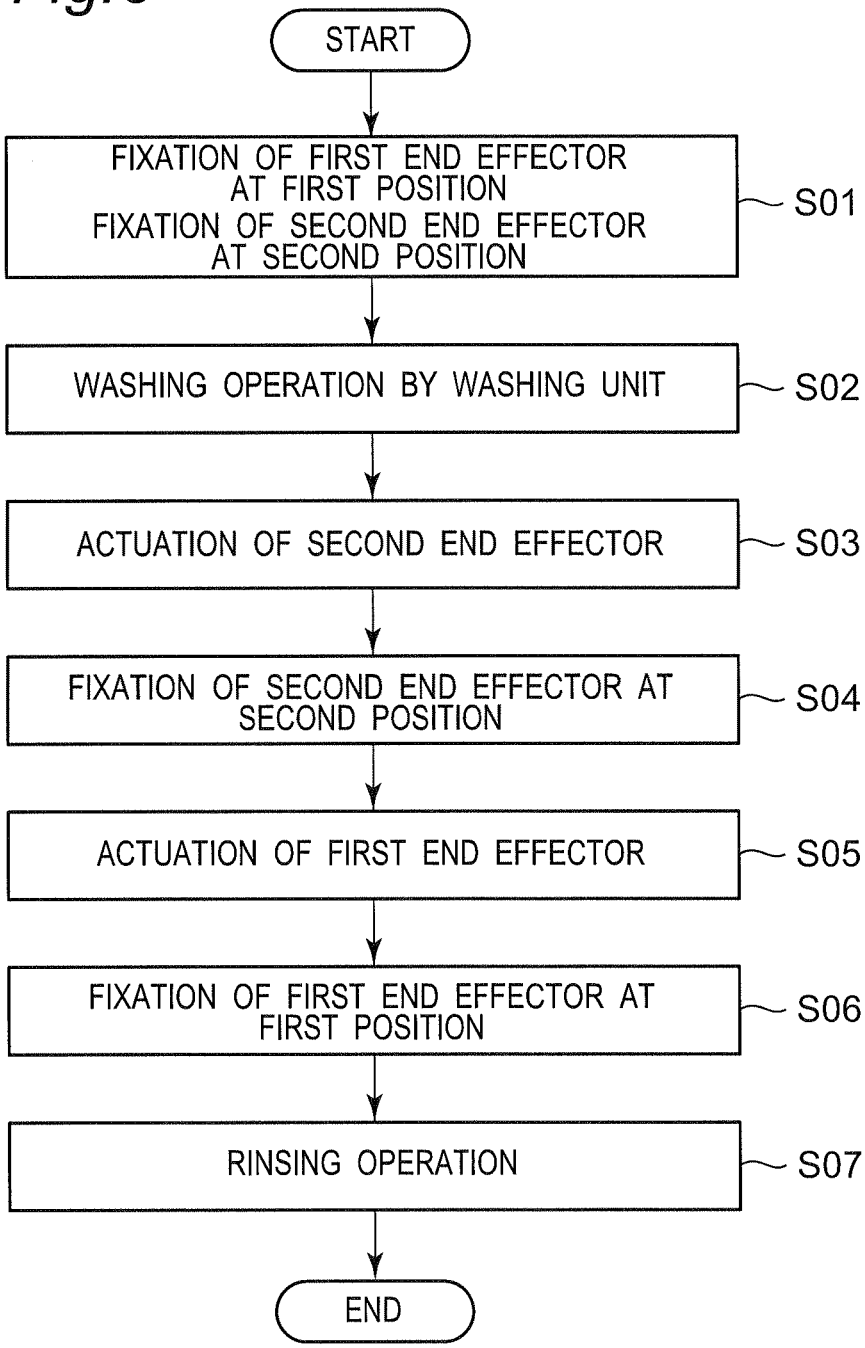
FIG. 6 is a flowchart showing an example of control of the automatic head washing apparatus according to the first embodiment.

FIG. 6 is a flowchart showing an example of control of the automatic head washing apparatus 11 according to the first embodiment. With reference to FIG. 6, the example of control of the automatic head washing apparatus 11 according to the first embodiment, is explained.

When the automatic head washing apparatus 11 is actuated, the control unit 19 controls the first driving unit 15 and the second driving unit 18, with the operational mode of the first end effector 13 and the second end effector 16 of the occipital region support 12 being set as a third mode. Thereby, the first end effector 13 is fixed at the first position, and the second end effector 16 is fixed at the second position (Step S01).

In this condition, a person inserts the head 21 into the bowl 31 of the automatic head washing apparatus 11, and the person puts the head 21 on the occipital region supporter 12.

Next, when it is confirmed that the head 21 is supported on the occipital region supporter 12, the control unit 19 makes it execute an automatic washing of the head 21 by the washing unit 28 (Step S02). The confirmation that the head 21 has been supported on the occipital region supporter 12, is performed on the basis of whether an output value from a pressure sensor mounted on the occipital region supporter 12 exceeds a predetermined value or not, for example.

In the washing operation by the washing unit 28, the swinging motion and push-rotating motion of the swing arms 32L, 32R, the movement of the contacts 33L, 33R, and the jetting of liquid from the nozzles 35 towards the head 21, are combined to each other. By the combination thereof, a region except a region of the head 21 which is supported on the occipital region supporter 21, is washed by the washing unit 28 automatically. When the washing operation by the washing unit 28 is finished, the control unit 19 stops the operation of the washing unit 28.

Subsequently, when the control unit 19 stops the operation of the washing unit 28, an automatic washing of the occipital region 22 by the occipital region supporter 12 is carried out.

When the washing operation by the occipital region supporter 12 is started, firstly, the control unit 19 switches the operational mode of the first end effector 13 and the second end effector 16 from the third mode to the first mode. Thereby, the second end effector 16 is actuated, or driven, in a state in which the first end effector 13 is fixed at the first position (Step S03). At the same time, the control unit 19 controls the liquid supply unit 30 so as to make the nozzle 20 jet the washing solution towards the occipital region 22. By actuating, or driving, the second end effector 16 in a state in which the head 21 is supported on the first end effector 13, the second region 24 of the occipital region 22 can be washed by rubbing, with the second end effector 16. At Step S03, the second end effector 16 is driven with at least one of the swinging motion in the direction A1 shown by the arrow in FIG. 2A, the vibrating motion in the direction of the X-axis in FIG. 2A, and the tapping motion in the direction of the Z-axis in FIG. 3A.

When the washing of the second region 24 of the occipital region 22 by the second end effector 16 is finished, the control unit 19 controls the liquid supply unit 30 so as to stop the jetting from the nozzle 20, and the control unit 19 switches the operational mode of the first end effector 13 and the second end effector 16 from the first mode to the third mode. By this switchover of the operational mode, the second end effector 16 is fixed at the second position (Step S04).

After Step S04, the control unit 19 switches the operational mode of the first end effector 13 and the second end effector 16 from the third mode to the second mode. Thereby, the first end effector 13 is driven in a state in which the second end effector 16 is fixed at the second position (Step S05). At the same time, the control unit 19 controls the liquid supply unit 30 so as to make the nozzle 20 jet the washing solution towards the occipital region 22. By actuating, or driving, the first end effector 13 in a state in which the head 21 is supported on the second end effector 16, the first region 23 of the occipital region 22 can be washed by rubbing, with the first end effector 13. At Step S05, the first end effector 13 is driven with at least one of the swinging motion in the direction A2 shown by the arrow in FIG. 2B, the vibrating motion in the direction of the X-axis in FIG. 2B, and the tapping motion in the direction of the Z-axis in FIG. 3B.

When the washing of the first region 23 of the occipital region 22 by the first end effector 13 is finished, the control unit 19 controls the liquid supply unit 30 so as to stop making the nozzle 20 jet the liquid, and the control unit 19 switches the operational mode of the first end effector 13 and the second end effector 16 from the second mode to the third mode. By this switchover of the operational mode, the first end effector 13 is fixed at the first position (Step S06).

Lastly, the control unit 19 controls the liquid supply unit 30 so as to execute the operation to rinse the head 21 (Step S07). Concretely, by supplying water to the nozzles 20, 35 from the liquid supply unit 30, and by making the nozzles 20, 35 jet the water towards the head 21, rinsing of the head 21 is performed. When the operation to rinse the head 21 is finished, the washing of the head 21 by the automatic head washing apparatus 11, is finished.

Second Embodiment

Figure 7A:
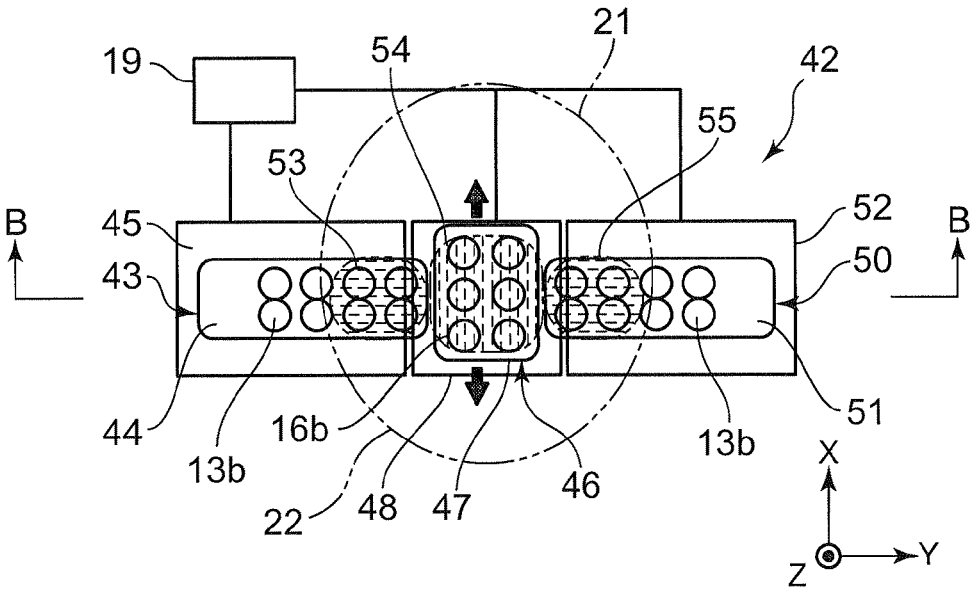
FIG. 7A is a schematic plan view for explaining an operation in a first mode of an occipital region supporter according to a second embodiment of the present invention.
Figure 7B:
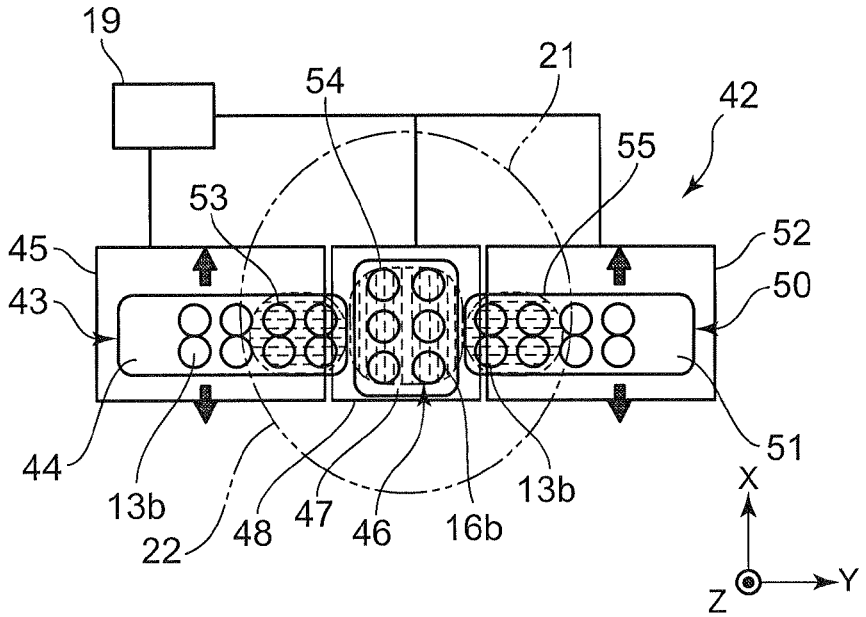
FIG. 7B is a schematic plan view for explaining an operation in a second mode of the occipital region supporter according to the second embodiment.

FIGS. 7A and 7B are views for explaining operations of an occipital region supporter 42 according to a second embodiment of the present invention. FIG. 7A is a schematic plan view of the occipital region supporter 42 in a first mode, and FIG. 7B is a schematic plan view of the occipital region supporter 42 in a second mode.

The second embodiment is the one in which the occipital region supporter 12 according to the first embodiment is replaced with the occipital region supporter 42. Hereinafter, the occipital region supporter 42 according to the second embodiment, is explained with reference to the drawings.

According to the aforementioned first embodiment, the first region 23 and the second region 24 of the side of the occipital region (occipital region 22) of the head 21, are set alternately in line in the direction of the X-axis, as shown in FIG. 1B. Meanwhile, according to the second embodiment, a second region 54 is set at the central part of the occipital region 22 in the direction of the Y-axis, a first region 53 is set to the right of the second region 54 of the occipital region 22, and a first region 55 is set to the left of the second region 54 of the occipital region 22, in which the second region 54 of the occipital region 22 is sandwiched between the first regions 53, 55, as shown in FIGS. 7A and 7B.

The occipital region supporter 42 of the automatic head washing apparatus 11 according to the second embodiment, has a pair of first end effectors 43, 50 and a single second end effector 46. The first end effectors 43, 50 are the first end effector 43 which can contact the first region 53 rightward of the occipital region 22 and the first end effector 50 which can contact the first region 55 leftward of the occipital region 22.

The first right end effector 43 has a plurality of contacts 13*b*, and a support body 44 which supports the contacts 13*b*. Similarly, the first left end effector 50 has a plurality of contacts 13*b*, and a support body 51 which supports the contacts 13*b*.

The second end effector 46 is arranged so as to be able to contact the second region 54 of the occipital region 22. The second end effector 46 has a plurality of contacts 16*b* and a support body 47 which supports the contacts 16*b*.

The occipital region supporter 42 has a first right-hand driving unit 45 for driving the first right end effector 43, a first left-hand driving unit 52 for driving the first left end effector 50, and a second driving unit 48 for driving the second end effector 46. By the way, in FIGS. 7A and 7B, each of the driving units 45, 48, 52 is shown schematically for simplicity. An example of concrete mechanism, or structure, of each of the driving units 45, 48, 52 is explained later.

Also, in the second embodiment, a first mode, a second mode and a third mode are set as the operational mode of the end effectors 43, 46, 50.

FIG. 7A is a view showing the first mode of the occipital region supporter 42. In FIG. 7A, the control unit 19 controls the first driving units 45, 52 so as to fix the first end effectors 43, 50 at a first position at which the first end effectors 43, 50 contact the first regions 53, 55 of the occipital region 22. Thereby, the head 21 is supported stably, by the first end effectors 43, 50, at two points which sandwich the central part of the occipital region 22. By the way, the first position of the first right end effector 43 and the first position of the first left end effector 50, are positions different from each other, at least in the direction of the Y-axis.

In the operation of the first mode, the control unit 19 controls the second driving unit 48 so as to make the second end effector 46 reciprocate in the direction of the X-axis. Thereby, the second region 54 which is a central part of the occipital region 22, can be washed by rubbing, with the second end effector 46.

FIG. 7B is a view showing an operation of the second mode of the occipital region supporter 42. In FIG. 7B, the control unit 19 controls the second driving unit 48 so as to fix the second end effectors 46 at a second position at which the second end effector 46 contacts the second region 54 of the occipital region 22. Thereby, the head 21 is supported stably, by the second end effectors 46, at the central part of the occipital region 22.

In the operation of the second mode, the control unit 19 controls the first driving units 45, 52 so as to make the first end effectors 43, 50 reciprocate in the direction of the X-axis. Thereby, the first regions 53, 55 which locate on the right and left of the occipital region 22, can be washed by rubbing, with the first end effectors 43, 50.

In the operation of the third mode, the control unit 19 fixes the first end effectors 43, 50 at the first position, and it fixes the second end effector 46 at the second end position. Thereby, the head 21 can be supported from below by the first end effectors 43, 50 and the second end effector 46. The operation of the third mode is executed, for example, at the time of automatic washing of the head 21 by the washing unit 28.

The first end effectors 43, 50 at the time of the operation of the first mode shown in FIG. 7A are set to be higher, in the direction of the Z-axis, than those at the time of the operation of the second mode shown in FIG. 7B. By this setting, the force of contact of the second end effector 46 with the second region 54 of the head 21 at the time of the operation of the first mode, is weaker than that at the time of the operation of the second mode. By weakening the force of contact of the second end effector 46 with the second region 54 of the head 21 at the time of the operation of the first mode, the rubbing movement of the second region 54 by the second end effector 46 can be realized preferably.

Also, the second end effector 46 at the time of the operation of the second mode shown in FIG. 7B is set to be higher, in the direction of the Z-axis, than that at the time of the operation of the first mode shown in FIG. 7A. By this setting, the force of contact of the first end effectors 43, 50 with the first regions 53, 55 of the occipital 22 at the time of the operation of the second mode, is weaker than that at the time of the operation of the first mode. By weakening the force of contact of the first regions 53, 55 of the occipital region 22 therewith at the time of the operation of the second mode, the rubbing movement of the first regions 53, 55 by the first end effectors 43, 50 can be realized preferably.

According to the second embodiment, at the first mode, a pair of the first end effectors 43, 50 supports the head 21 at two points which sandwich a center of the head 21, and at the second mode, the second effector 46 supports the center of the head 21. Therefore, at the time of automatic washing of the occipital region 22 by the occipital region supporter 42, the head 21 is always supported stably thereby, and it is possible to give a feeling of relief to the person whose head is washed.

If the direction in which each of the end effectors 43, 46, 50 reciprocates, is the one which can realize an operation of kneading the occipital region 22, the direction can be a direction other than the direction of the X-axis (for example, direction of the Y-axis). Also, as to the movement, or operation, of the end effectors 43, 46, 50, movements, or operations, of reciprocations in a plurality of directions can be performed simultaneously. For example, by executing a reciprocation thereof in the direction of the X-axis and a reciprocation thereof in the direction of the Y-axis at the same time, the end effectors 43, 46, 50 are driven so as to draw a Lissajous figure, by which it is possible to perform a delicate kneading-and-washing operation.

Although, as to the second embodiment, a case where the occipital region supporter 42 has a pair of first end effectors 43, 50 and a single second end effector 46, has been explained, the number of the first end effector(s) and the second end effector (s) can be altered. For example, there can be arranged a plurality of first end effectors and a plurality of second end effectors, so that a group of three first end effectors and a group of two second end effectors, alternate in line with each other. In this case, also, by controlling it at the operational mode with the control unit 19, an effect similar to that mentioned above, can be realized.

Figure 8A:
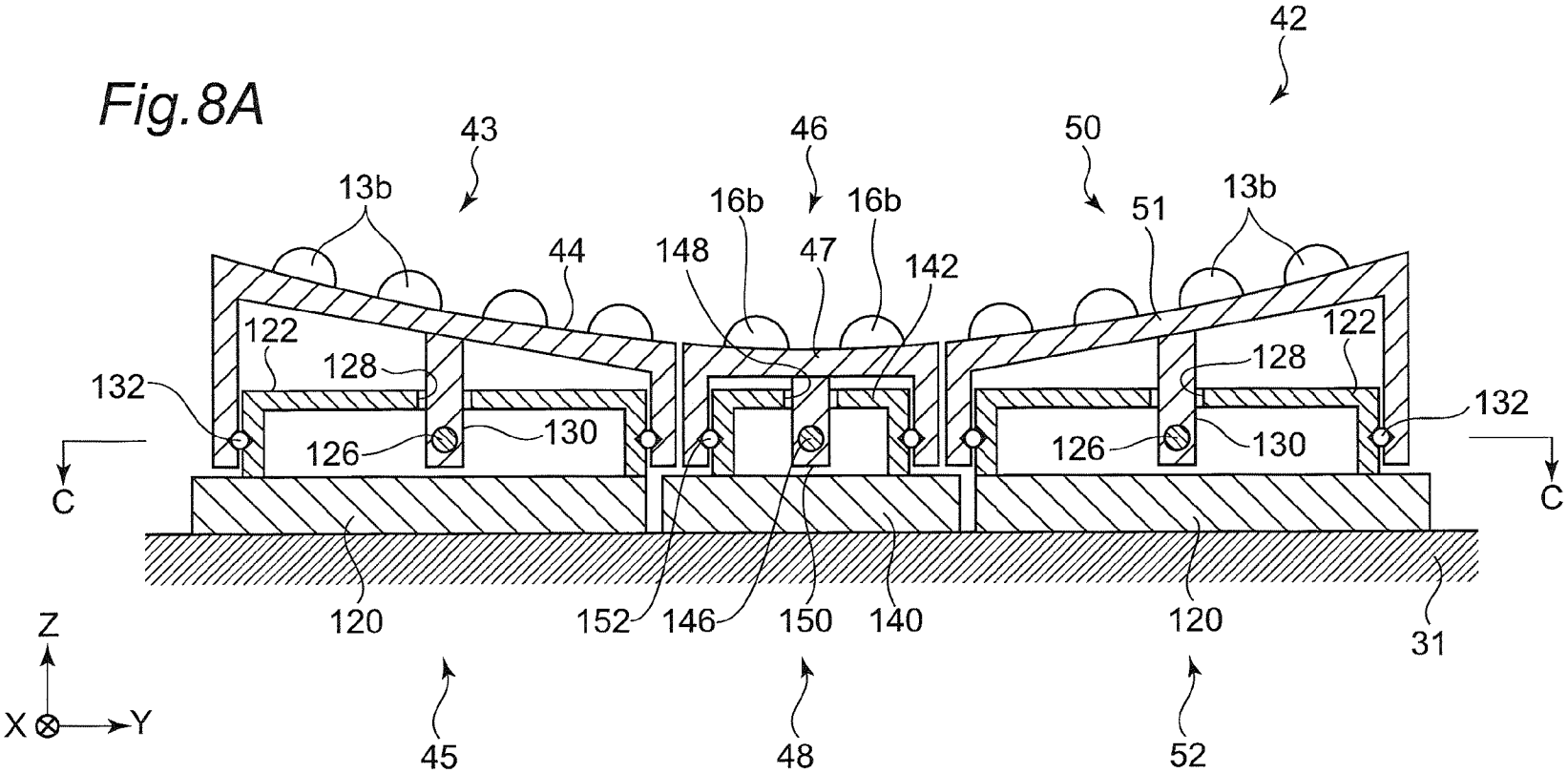
FIG. 8A is a cross-sectional view along a line B-B in FIG. 7A, for explaining an example of a specific mechanism of first driving units and a second driving unit according to the second embodiment.
Figure 8B:
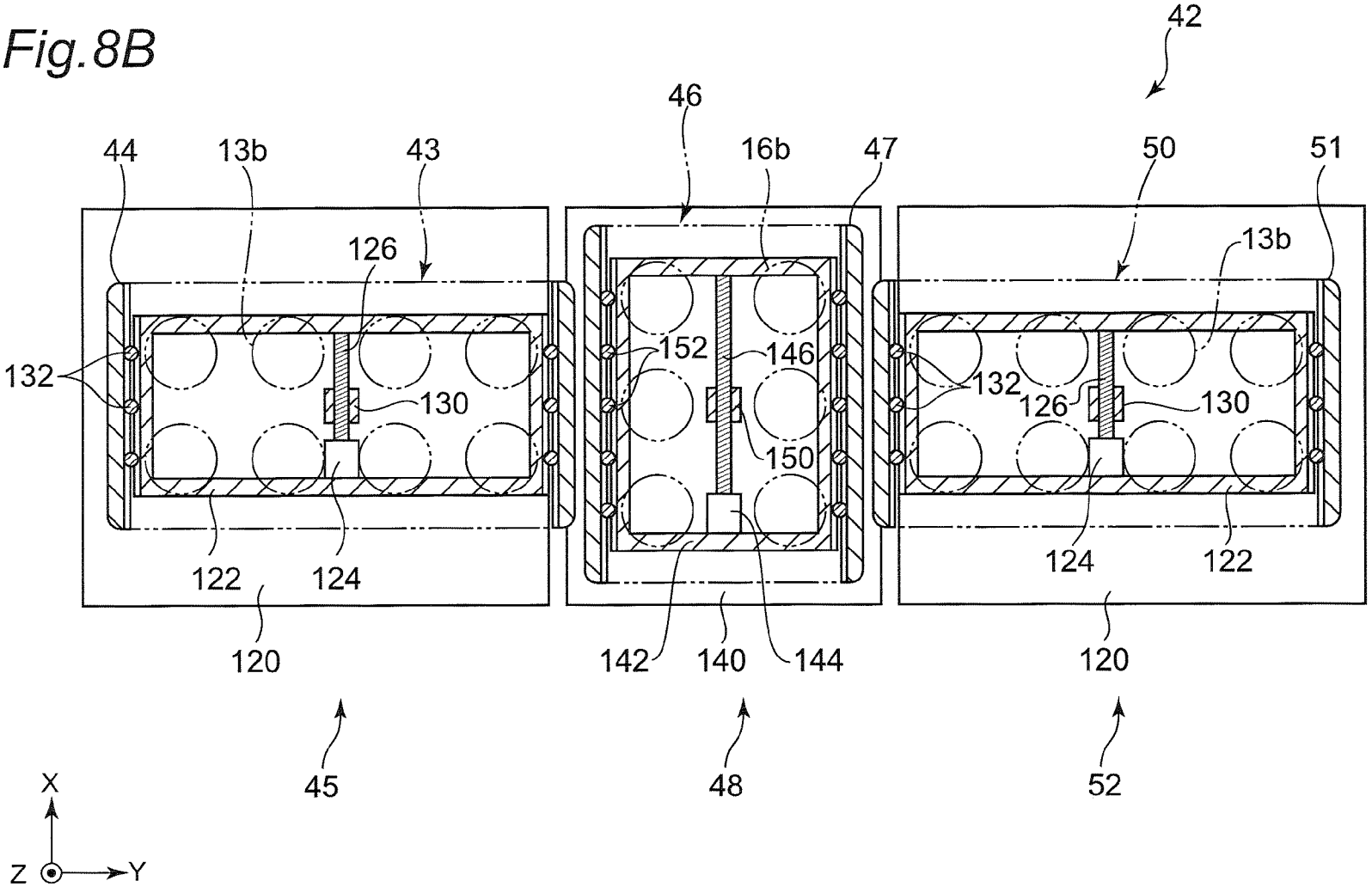
FIG. 8B is a cross-sectional view along a line C-C in FIG. 8A.

FIG. 8A is a cross-sectional view along a line B-B in FIG. 7A, for explaining an example of a specific mechanism of the first driving units 45. 52 and the second driving unit according to the second embodiment. FIG. 8B is a cross-sectional view along a line C-C in FIG. 8A.

As shown in FIGS. 8A and 8B, each of the first driving units 45, 52 has a base piece 120 which is fixed on a bottom surface of the bowl 31, a housing 122 which is fixed on the base piece 120, a screw 126 which is mounted inside the housing 122 so as to extend in the direction of the X-axis, and a motor 124 for driving to rotate the screw 126.

On the housing 122, support bodies 44, 51 of the first end effectors 43, 50 are mounted slidably in the direction of the X-axis. By the way, between the housing 122 and each of the support bodies 44, 51, balls 132 for reducing friction are mounted.

The screw 126 engages a nut 130 which is fixed on each of the support bodies 44, 51 of the first end effectors 43, 50. With this construction, when the motor 124 is actuated, the first end effectors 43, 50 are moved along with the nuts 130 in the direction of the X-axis, in association with the rotation of the screws 126.

Similarly, the second driving unit 48 has a base piece 140 which is fixed on the bottom surface of the bowl 31 for example, a housing 142 which is fixed on the base piece 140, a screw 146 which is mounted inside the housing 142 so as to extend in the direction of the X-axis, and a motor 144 for driving to rotate the screw 146.

On the housing 142, a support body 47 of the second end effectors 46 is mounted slidably in the direction of the X-axis.

By the way, between the housing 142 and the support body 47, balls 152 for reducing friction are mounted.

The screw 146 engages a nut 150 which is fixed on the support body 47 of the second end effector 46. With this construction, when the motor 144 is actuated, the second end effector 46 is moved along with the nut 150 in the direction of the X-axis, in association with the rotation of the screw 146.

The part of the upper surface of each of the housings 122, 142, is provided with an opening 128, 148, in order to avoid interference with the nut 130, 150. Also, it is desirable to provide each of the motors 124, 144 with an encoder. By providing each thereof with the encoder, the control unit 19 can detect positions of the first end effectors 43, 50 and the second end effector 46, on the basis of the output value from the encoder.

With the above construction, the reciprocating movement of the second end effector 46 in the direction of the X-axis in the first mode, and the reciprocating movement of the first end effectors 43, 50 in the direction of the X-axis in the second mode, can be realized preferably.

As to the mechanism of the first driving units 45, 52 and the second driving unit 48 in the second embodiment, it is merely an example, and it is also possible to adopt another mechanism thereof.

Figure 9A:
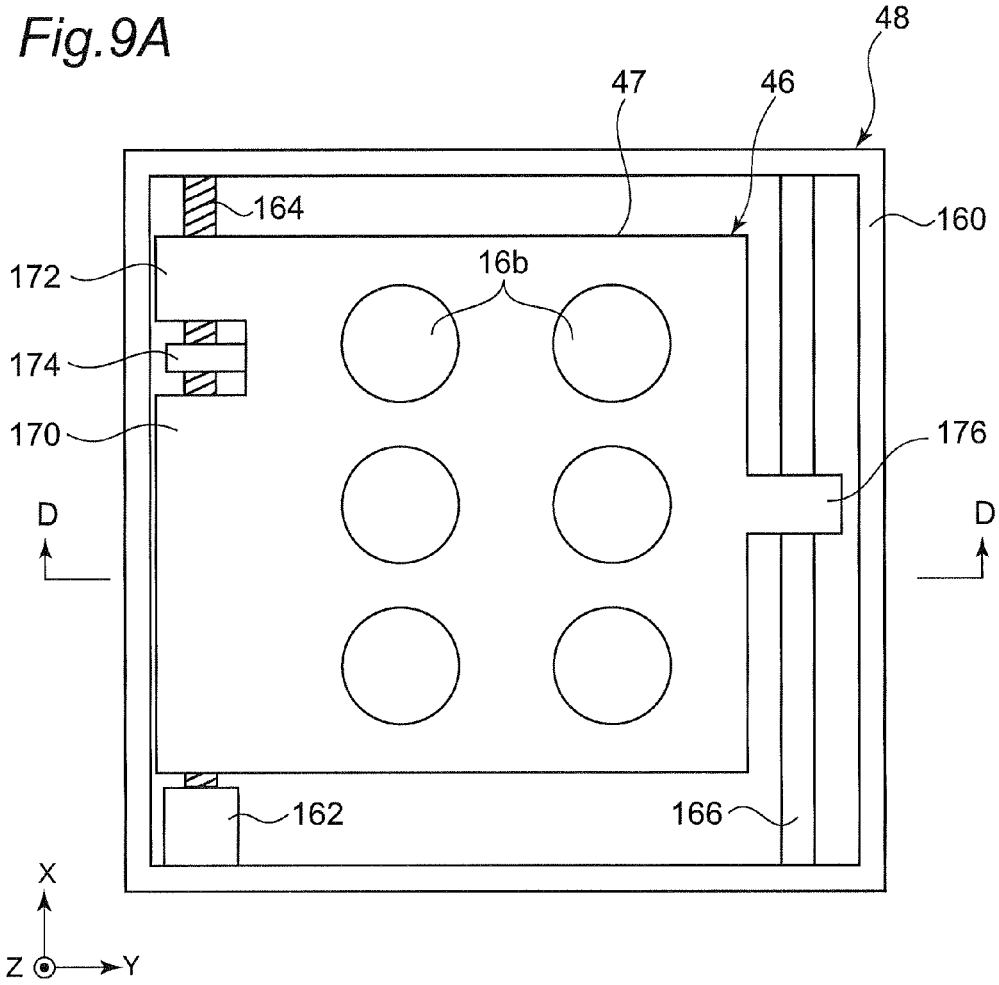
FIG. 9A is a plan view for explaining another example of a specific mechanism of the second driving unit according to the second embodiment.
Figure 9B:
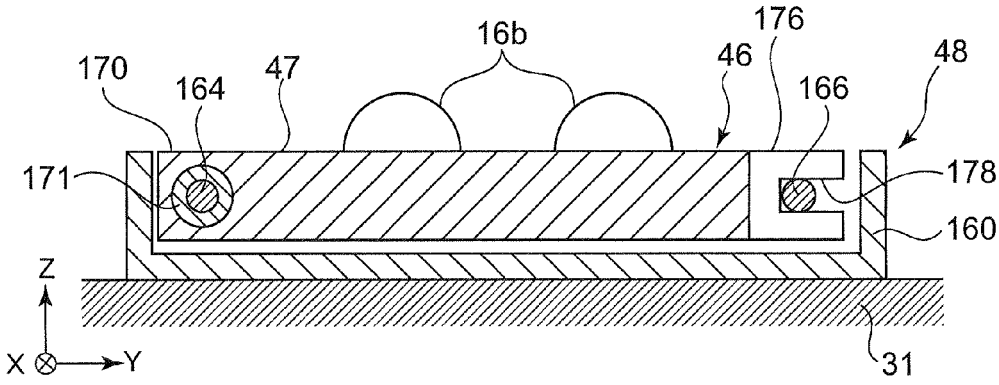
FIG. 9B is a cross-sectional view along a line D-D in FIG. 9A.

FIG. 9A is a plan view for explaining another example of a specific mechanism of the second driving unit 48 according to the second embodiment, and FIG. 9B is a cross-sectional view along a line D-D in FIG. 9A.

In the example of a mechanism shown in FIGS. 9A and 9B, the second driving unit 48 has a housing 160 which is fixed to the bottom surface of the bowl 31, a screw 164 which is mounted inside the housing 160 so as to extend in the direction of the X-axis, a motor 162 for driving to rotate the screw 164, and a guide shaft 166 which is mounted inside the housing 160 so as to extend in the direction of the X-axis. The screw 164 and the guide shaft 166 are arranged separately in the direction of the Y-axis.

One end part, in the direction of the Y-axis, of the support body 47 of the second end effector 46, is provided with a penetrated portion 170 through which the screw 164 passes, and with a nut portion 172 which engages the screw 164. By the way, a plate spring 174, which is pressed against the screw 164, is mounted on the support body 47 in the vicinity of the nut portion 172. As shown in FIG. 9B, a cylindrical-shaped slide material 171 for reducing friction against the screw 164, is mounted inside the penetrated portion 170. As the slide material 171, an oil-bearing metal or polyacetal is employed, for example.

The other end part, in the direction of the Y-axis, of the support body 47, is provided with a guide portion 170 which is guided by the guide shaft 166. The guide portion 176 has a groove 178 which is formed open outwardly in the direction of the Y-axis. The guide shaft 166 is engaged inside the groove 178 of the guide portion 176.

With the above construction, when the motor 162 is actuated, the second end effector 46 is moved along with the nut portion 172 in the direction of the X-axis, in association with the rotation of the screw 164. At this time, the penetrated portion 170 of the support body 47 of the second end effector 46 is guided by the screw 164. By guiding the guide portion 176 with the guide shaft 166, the support body 47 of the second end effector 46 is moved smoothly in the direction of the X-axis. Accordingly, with this construction, the reciprocating movement of the second end effector 46 in the direction of the X-axis in the first mode, can be realized preferably.

In the example of the mechanism shown in FIGS. 9A and 9B, the second driving unit 48 can be provided with a plurality of guide shafts, and the support body 47 can be provided with a plurality of guide portions which correspond to the guide shafts, respectively. Also, the example of the mechanism shown in FIGS. 9A and 9B, can apply not only to the second driving unit 48, but also to the first driving units 45, 52. In a case where the example of the mechanism shown in FIGS. 9A and 9B applies to the first driving units 45, 52, the reciprocating movement of the first end effectors 43, 50 in the direction of the X-axis in the second mode, can be realized preferably.

Third Embodiment

Figure 10:
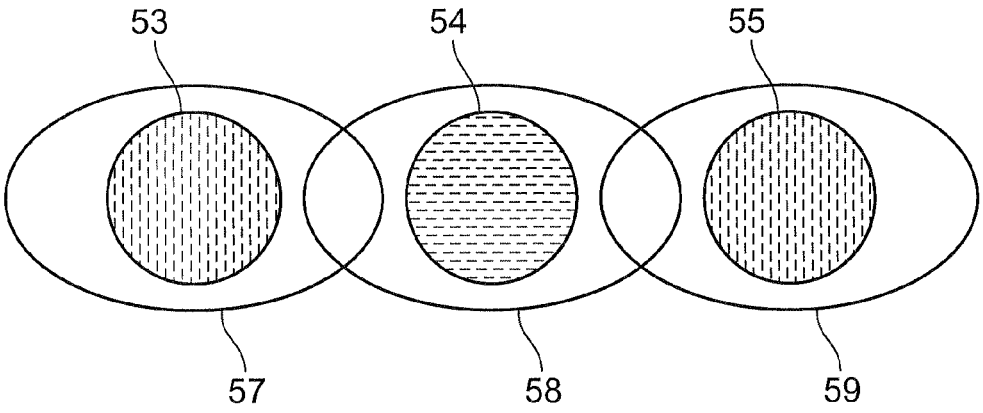
FIG. 10 is a conceptual diagram for explaining a relation amongst a first region, a second region, a third region, a first contact region, a second contact region, and a third contact region, according to a third embodiment of the present invention.
Figure 11A:
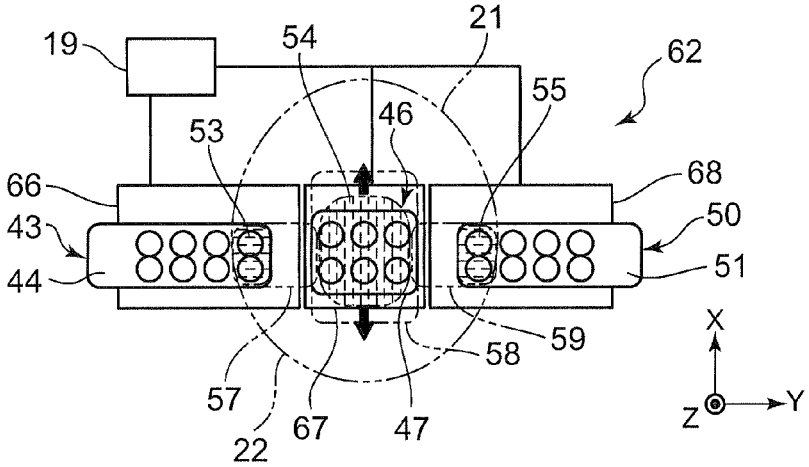
FIG. 11A is a schematic plan view for explaining an operation in a first mode of an occipital region supporter according to the third embodiment.
Figure 11B:
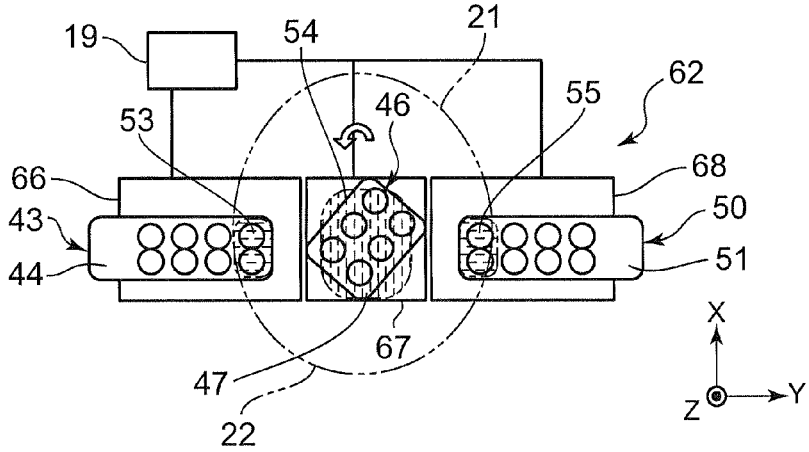
FIG. 11B is a schematic plan view for explaining an operation at time of switching from the first mode to a second mode of the occipital region supporter according to the third embodiment.
Figure 11C:
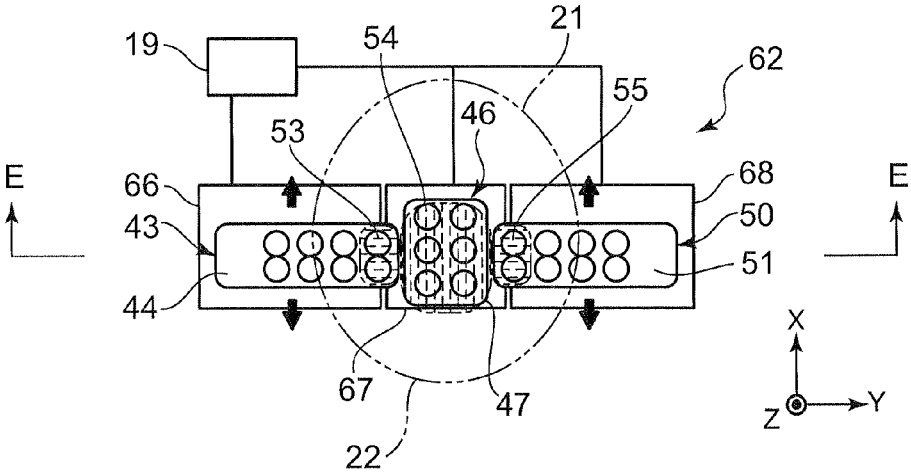
FIG. 11C is a schematic plan view for explaining an operation in the second mode of the occipital region supporter according to the third embodiment.

FIG. 10 is a conceptual diagram for explaining a relation amongst first regions 53, 55, a second region 54, first contact regions 57, 59, and a second contact region 58, according to a third embodiment of the present invention. FIG. 11A is a schematic plan view for explaining an operation in a first mode of an occipital region supporter 62 according to the third embodiment. FIG. 11B is a schematic plan view for explaining an operation at time of switching from the first mode to a second mode of the occipital region supporter 62. FIG. 11C is a schematic plan view for explaining an operation in the second mode of the occipital region supporter 62.

In the third embodiment, the occipital region supporter 42 according to the second embodiment, is replaced with the occipital region supporter 62. With reference to the drawings, points that the third embodiment is different from the second embodiment, are explained below.

In the occipital region supporter 62 in a state shown in FIG. 11A, there exists a space or gap, constitutionally, between the first right end effector 43 and the second end effector 46, and between the second end effector 46 and the first left end effector 50. With this construction, on the side of the occipital region (occipital region 22) of the head 21, there is also a space or gap between each of the first regions 53, 55 with which the first end effectors 43, 50 contact, and the second region 54 with which the second end effector 46 contacts.

By reciprocating the end effectors 43, 46, 50 in the direction of the X-axis, the occipital region supporter 62 can rub, or scrub, the first regions 53, 55 and the second region 54 of the occipital region 22. However, thereby, the occipital region supporter 62 can not rub, nor scrub, the region between each of the first regions 53, 55, and the second region 54. Here, if the end effectors 43, 46, 50 are moved in the direction of the Y-axis up to a position at which there is no space, or no gap, between each of the first regions 53, 55, and the second region 54, there is a possibility that the end effectors 43, 46, 50 may interfere one another.

Therefore, in the third embodiment, it makes it possible to rub, or scrub, the region between each of the first regions 53, 55, and the second region 54, while preventing the end effectors 43, 46, 50 from interfering one another, by controlling the first driving units 66, 68 and the second driving unit 67 with the control unit 19. Concretely, the control unit 19 controls the first driving units 66, 68 and the second driving unit 67 for actuating, or driving, the first end effectors 43, 50 and the second end effector 46, so as to overlap each of first contact regions (first washing regions) 57, 59, in the occipital region 22, which are rubbed, or scrubbed, by the first end effectors 43, 50 in the second mode, with a second contact region (a second washing region) 58, in the occipital region 22, which is rubbed, or scrubbed, by the second end effector 46 in the first mode, partially. Hereafter, the control of the automatic head washing apparatus 11 according to the third embodiment, is explained.

Firstly, at time of switching the operational mode of the occipital region supporter 62, the control unit 19 controls it so as to switch or change, directions or orientations, of the end effectors 43, 46, 50. Thereby, as shown in FIG. 10, the first contact region 57, including the first region 53 rubbed by the first right end effector 43, overlaps with the second contact region 58, including the second region 54 rubbed by the second end effector 46. Similarly, the second contact region 58 overlaps with the first contact region 59, including the first region 55 rubbed by the first left end effector 50. By overlapping the contact regions 57, 58, 59 with one another in this manner, unwashed part can be prevented from remaining in the occipital region 22.

Next, the control for switching the operational mode of the occipital region supporter 62 from the first mode to the second mode, so as to overlap adjacent contact regions 57, 58, 59 mutually and partially, is explained.

As shown in FIG. 11A, in the first mode, the support body 47 of the second end effector 46 is arranged so that the width thereof in the direction of the Y-axis is greater than that in the direction of the X-axis. With the second end effector 46 being arranged in such a direction, the control unit 19 controls the second driving unit 67 so that the second end effector 46 is reciprocated in the direction of the X-axis. Thereby, it is possible to wash the second contact region 58 in the occipital region 22 by rubbing.

When the washing of the occipital region 22 by rubbing is finished in the first mode, the control unit 19 makes the second end effector 46 rotate about its shaft in the direction of the Z-axis, as shown in FIG. 11B. Here, the angle of rotation of the second end effector 46, is 90°, for example.

When the rotation of the second end effector 46 is finished, the support body 47 of the second end effector 46 is arranged, or orientated, so that the width thereof in the direction of the X-axis is greater than that in the direction of the Y-axis, as shown in FIG. 11C. That is, the support body 47 of the second end effector 46, has a shape, or a configuration, such as a rectangle or an ellipse, that has a long axis and a short axis, the length of which is different from that of the long axis in an X-Y plane, in which the orientation, or direction, of the long axis changes when it rotates about its shaft in the direction of the Z-axis. With the second end effector 46 being arranged in this direction or orientation, the control unit 19 controls the first driving units 66, 68 so that the first end effectors 43, 50 are moved in the direction of the Y-axis so as to approach the second end effector 46. At this time, the width, in the direction of the Y-axis, of the support body 47 of the second end effector 46, is smaller than that in the first mode. Therefore, the possibility of interfering the first end effectors 43, 50 with the second end effector 46, can be reduced.

Subsequently, the control unit 19 controls the first driving units 66, 68 as an operation of the second mode, so that the first end effectors 43, 50 are reciprocated in the direction of the X-axis. Thereby, the first contact regions 57, 57 of the occipital region 22, can be washed by rubbing. In the third embodiment, since the first contact regions 57, 57 are arranged so as to overlap the second contact region 58 partially, unwashed part can be prevented from remaining in the occipital region 22.

Thus, in the third embodiment, by rotating the second end effector 46 about its shaft in the direction of the Z-axis, and by moving the first end effectors 43, 50 in the direction of the Y-axis, adjacent contact regions 57, 58, 59 are overlapped partially with each other. Thereby, unwashed part can be prevented from remaining in the occipital region 22.

In the third embodiment, the first end effectors 43, 50 can be reciprocated in the direction of the Y-axis in the second mode, by omitting the movement of the first end effectors 43, 50 in the direction of the Y-axis at the time of switchover from the first mode to the second mode. In this case, it is also possible to overlap the first contact regions 57, with the second contact region 58, whilst avoiding interference of the first end effectors 43, 50 with the second end effector 46. In this case, the reciprocating movement of the first end effectors 43, 50 in the second mode, can be the one only in the direction of the Y-axis, or it can be the one, like drawing a Lissajous figure, according to a combination of the reciprocating movement in the direction of the X-axis with the reciprocating movement in the direction of the Y-axis.

Also, the second end effector 46 can be reciprocated in the direction of the Y-axis in the first mode, by omitting the movement of the first end effectors 43, 50 in the direction of the Y-axis at the time of switchover from the first mode to the second mode. In this case, it is also possible to overlap the first contact regions 57, 59 with the second contact region 58, whilst avoiding interference of the first end effectors 43, 50 with the second end effector 46. In this case, the reciprocating movement of the second end effector 46 in the first mode, can be the one only in the direction of the Y-axis, or it can be the one, like drawing a Lissajous figure, according to a combination of the reciprocating movement in the direction of the X-axis with the reciprocating movement in the direction of the Y-axis.

Figure 12:
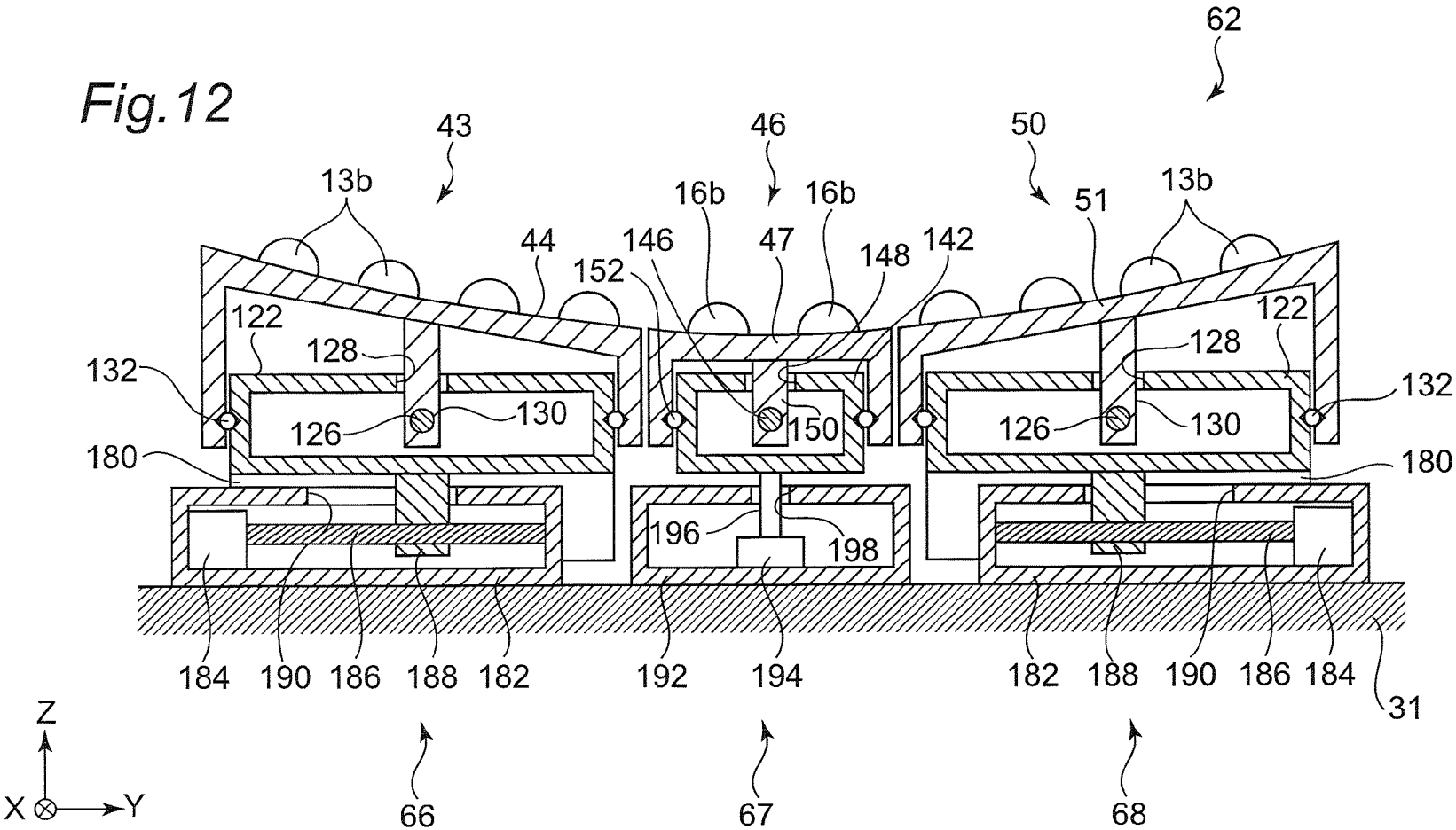
FIG. 12 is a cross-sectional view along a line E-E in FIG. 11C, for explaining an example of a specific mechanism of first driving units and a second driving unit according to the third embodiment.

FIG. 12 is a cross-sectional view along a line E-E in FIG. 11C, for explaining an example of a specific mechanism of the first driving units 66, 68 and the second driving unit 67 according to the third embodiment.

The mechanism of the example shown in FIG. 12, is a mechanism which partially employs the mechanism shown in FIGS. 8A and 8B as aforementioned. Therefore, as to constitutional parts, or components, which are common to those in the mechanism shown in FIGS. 8A and 8B, the same reference symbols, or numerals, are used in FIG. 12, and its detailed explanation is omitted.

Each of the first driving units 66, 68 has a housing 182 which is fixed on the bottom surface of the bowl 31, a screw 186 which extends inside the housing 182 in the direction of the Y-axis, and a motor 184 for driving to rotate the screw 186.

In each of the first driving units 66, 68, there are arranged a pair of extended portions 180 which extend downwardly from both ends, in the direction of the X-axis, of the housing 122. The pair of extended portions 180 engages the housing 182 slidably in the direction of the Y-axis. By the way, (unshown) balls for reducing friction are interposed between the housing 182 and the extended portions 180.

The screw 186 engages a nut 188 which is fixed to the housing 122. With this construction, when the motor 184 is actuated or driven, the housing 122 and the first end effector 43, 50 are moved along with the nut 188 in the direction of the Y-axis, in association with the rotation of the screw 186.

An upper part of the housing 182 which accommodates the screw 186, has an opening 190 for avoiding interference with the nut 188. Also, it is desirable to provide the motor 184 with an encoder. With the provision of the encoder, the control unit 19 can detect positions of the first end effectors 43, 50 in the direction of the Y-axis.

With the above construction in the third embodiment, it is possible to move the first end effectors 43, 50 in the direction of the Y-axis so as to make them approach the second end effector 46, at the time of switchover from the first mode to the second mode.

The second driving unit 67 has a housing 192 which is fixed on the bottom surface of the bowl 31, a motor 194 which is accommodated inside the housing 192 with its output shaft being orientated in the direction of the Z-axis, and a shaft 196 which connects the motor 194 with the housing 142, the shaft 196 extending in the direction of the Z-axis.

The upper surface of the housing 192 is provided with an opening 198 in order to avoid interference with the shaft 196.

When the motor 194 is driven, the housing 142 which is connected to the motor 194 via the shaft 196, is rotated, and the second end effector 46 is rotated about its shaft in the direction of the Z-axis along with the housing 142.

With this construction, in the third embodiment, the second end effector 46 can be rotated in a direction in which the width thereof becomes shorter in the direction of the Y-axis, by rotating the second end effector 46 at the time of switchover from the first mode to the second mode.

Fourth Embodiment

Figure 13:
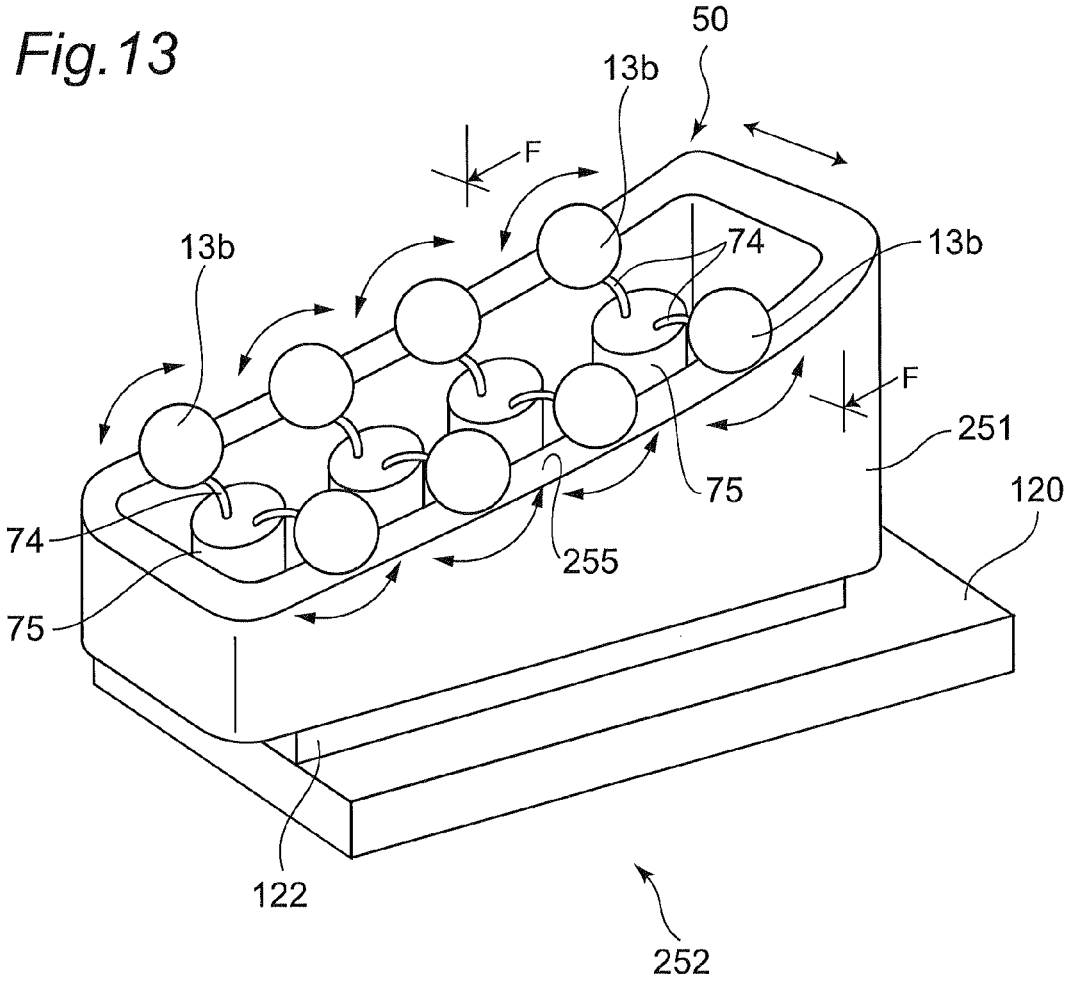
FIG. 13 is a perspective view showing a first end effector and a first driving unit thereof according to a fourth embodiment of the present invention.
Figure 14A:
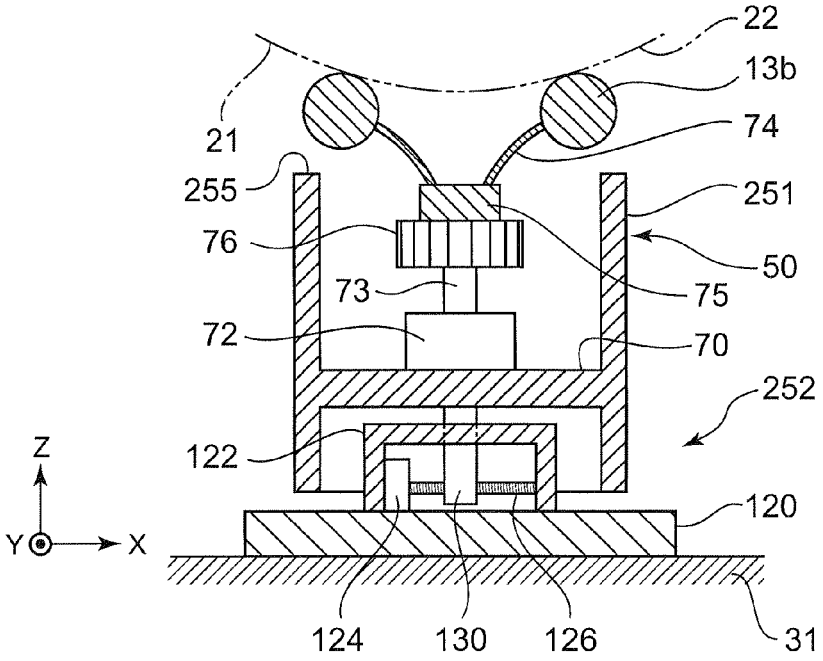
FIG. 14A is a cross-sectional view along a line F-F in FIG. 13, which shows a condition of washing by the first end effector shown in FIG. 13.
Figure 14B:
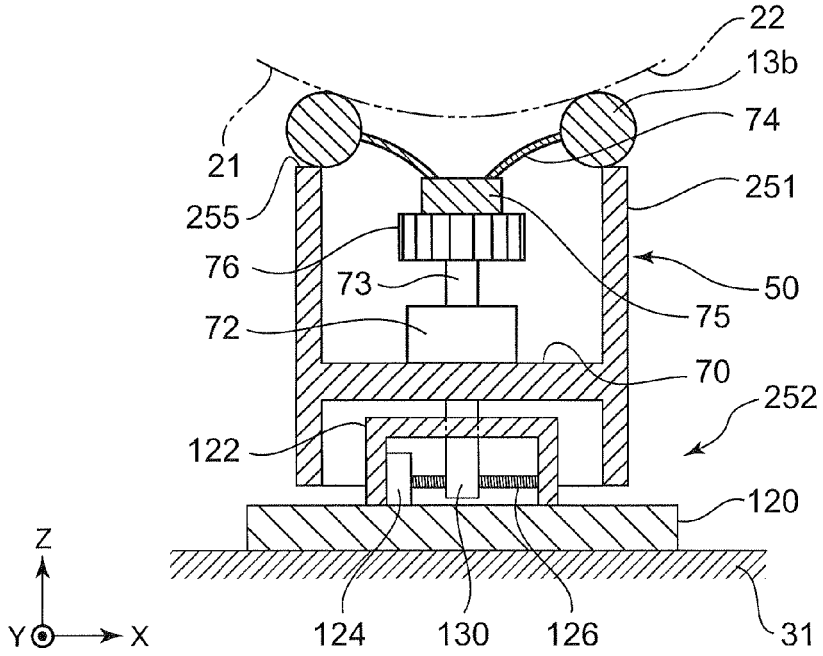
FIG. 14B is a cross-sectional view along a line F-F in FIG. 13, which shows a condition of support by the first end effector shown in FIG. 13.
Figure 15A:
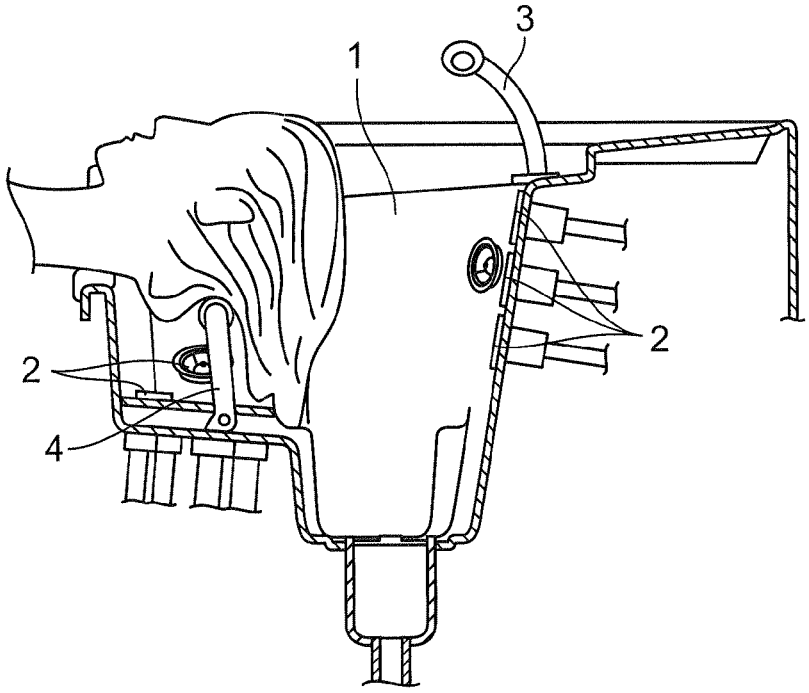
FIG. 15A is a cross-sectional view showing a condition at time of washing hair by an automatic hair washing apparatus according to prior art.
Figure 15B:
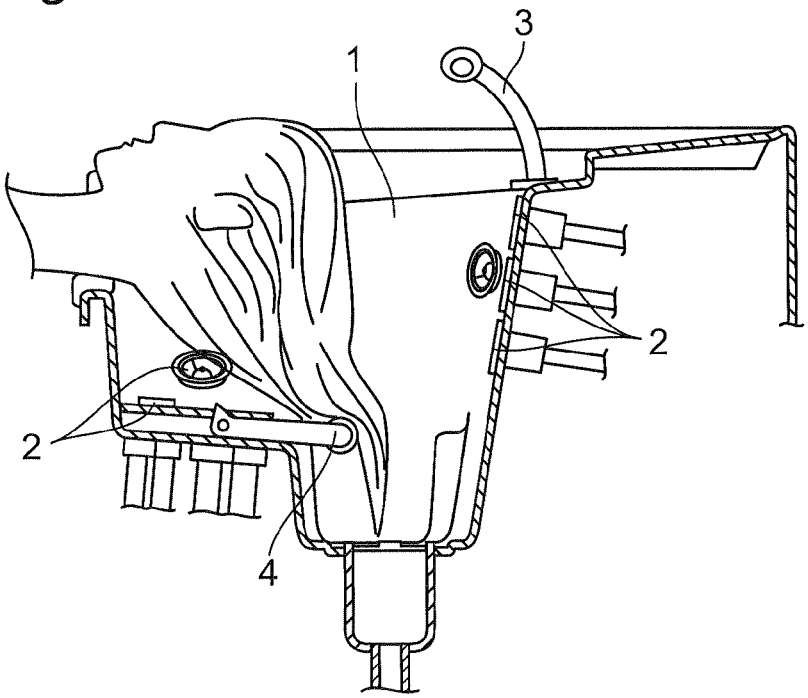
FIG. 15B is a cross-sectional view showing a condition at time of washing the occipital region of the head by the automatic hair washing apparatus according to prior art.

FIG. 13 is a perspective view showing a first end effector 50 and a first driving unit 252 according to a fourth embodiment of the present invention. FIGS. 14A and 14B are views for explaining the first driving unit 252 according to the fourth embodiment. FIG. 14A is a cross-sectional view along a line F-F in FIG. 13, which shows a condition of washing by the first end effector 50. FIG. 14B is a cross-sectional view along the line F-F in FIG. 13, which shows a condition of support by the first end effector 50.

In the fourth embodiment, the first driving unit 52 according to the second embodiment, is replaced with the first driving unit 252. With reference to the drawings, points that the fourth embodiment is different from the second embodiment, are explained below.

The first driving unit 252 according to the fourth embodiment, has a mechanism which partially employs the mechanism shown in FIGS. 8A and 8B as aforementioned. Therefore, as to constitutional parts, or components, which are common to those in the mechanism shown in FIGS. 8A and 8B, the same reference symbols, or numerals, are used in FIGS. 13, 14A and 14B, and its detailed explanation is omitted.

As shown in FIGS. 14 A and 14B, a support body 251 of the first driving unit 252, has a partition plate 70 which partitions an inner space of the support body 251 into upper and lower spaces. Components, or constitutional members, locating under the partition plate 70 of the first driving unit 252, are the same as those shown in FIGS. 8A and 8B.

As shown in FIG. 13, the first driving unit 252 has a plurality of support pieces 75 for supporting contacts 13*b*. For example, a pair of contacts 13*b* are connected to each of the support pieces 75 via rod-shaped elastic pieces 74. The contacts 13*b* are arranged on top of the support body 251. The support piece 75 is an example of a contact rotating piece.

As shown in FIGS. 14A and 14B, a gear 76 is fixed on a lower surface of each of the support pieces 75. All the gears 76, fixed on the support pieces 75, are constructed to engage one another. Thereby, a rotation of one gear 76 makes it possible to rotate all the gears 76. One of the gears 76 in the first driving unit 252, is connected to an output shaft 73 of a motor 72 orientating in the direction of the Z-axis. The motor 72 is fixed on the partition plate 70.

When the motor 72 is driven by a control signal transmitted from the control unit 19, one gear 76 which is coupled to the motor 72, and the other remaining gears 76 which engage the above one gear 76, are driven to rotate. At this time, the support pieces 75 which are fixed on the respective gears 76, and the elastic pieces 74 which are fixed to the support pieces 75, are rotated about their shafts, or axes, in the direction of the Z-axis. As a result, the contacts 13*b* which are fixed on upper parts of the elastic pieces 74, are swung around in the direction shown by arrows in FIG. 13. Thereby, such a movement as kneading the occipital region 22 by the contacts 13*b*, can be realized. Such a movement as kneading by the contacts 13*b*, can be employed for the automatic washing of the occipital region 22.

As aforementioned, the contacts 13*b* are arranged on the upper surface, or top, of the support body 251, and the contacts 13*b* are fixed to the support pieces 75 via the elastic pieces 74. Therefore, in accordance with load exerted from the occipital region 22, the contacts 13*b* are displaced downward as the elastic pieces 74 are deformed. At this time, the upper surface of the support body 251, which is arranged under the contacts 13*b* at a distance therefrom, functions as a load-receiving piece 255 for receiving the load of the occipital region 22 when the contacts 13*b* being displaced downward by the load of the occipital region 22 contact the upper surface of the support body 251. The load-receiving piece 255 is an example of a base piece.

As shown in FIG. 14A, since the contacts 13*b* are fixed to the support pieces 75 through the elastic pieces 74, the contacts 13*b* can be pressed against the occipital region 22 with a relatively small force. Therefore, when the occipital region 22 is washed by the first end effector 50, the movement of kneading the occipital region 22 by the contacts 13*b* can be realized preferably, with the contacts 13*b* contacting the occipital region 22 gently.

On the other hand, as shown in FIG. 14B, when the occipital region 22 is supported by, or on, the first end effector 50, the contacts 13*b* are displaced downward due to the weight of the head 21, and the contacts 13*b* are supported on the load-receiving piece 255 directly. Thereby, the head 21 can be supported thereon stably.

In the fourth embodiment, a case that the first left-hand driving unit 52 according to the second embodiment, is replaced with the first driving unit 252 having the above mechanism, has been explained. Also, the first right-hand driving unit 45, or the second driving unit 48, according to the second embodiment, can be replaced with the second driving unit or the first driving unit having the similar mechanism.

Also, as to the first driving unit, it is possible to combine a mechanism for moving the first driving unit in the direction of the Y-axis as explained in the above third embodiment, with the mechanism explained in the fourth embodiment. Further, as to the second driving unit, it is possible to combine a mechanism for rotating the second driving unit about its shaft in the direction of the Z-axis as explained in the above third embodiment, with a mechanism similar to the mechanism explained in the fourth embodiment.

Although the present invention has been explained in connection with several embodiments thereof, these embodiments are merely examples. Accordingly, what is comprised of the first to fourth embodiments combined arbitrarily, various changes, modifications or improvements, based on knowledge of a person skilled in the art, can be put into execution within the scope of the present invention unless they depart therefrom.

INDUSTRIAL APPLICABILITY

The automatic head washing apparatus according to the present invention, can wash the head automatically without leaving unwashed part thereof while supporting the head reliably and surely. Accordingly, the apparatus is useful in a medicare industry or hairdressing and beauty industry in which the washing of the head is performed.

Explanation of Numerals

11 automatic head washing apparatus
12, 42, 62 occipital region supporter
13 first end effector

13*b*, 16*b*, 33L, 33R contacts
15, 66, 68, 252 first driving unit
16, 46 second end effector
18, 48, 67 second driving unit
19 control unit
20, 35 nozzle
21 head
22 occipital region
23, 53, 55 first region
24, 54 second region
31 bowl
32L, 32R swing arm
34L, 34R pipe
36L, 36R rotating shaft
43 first right end effector
45 first right-hand driving unit
50 first left end effector
52 first left-hand driving unit
57, 59 first contact region
58 second contact region
74 elastic piece
255 load-receiving piece

The invention claimed is:

1. An automatic head care apparatus for caring a person's head automatically, which comprises:
- a first contact unit;
- a second contact unit;
- a first driving unit for driving the first contact unit;
- a second driving unit for driving the second contact unit; and
- a control unit for controlling the first driving unit and the second driving unit,
- wherein the control unit controls the first driving unit and the second driving unit in a plurality of modes, including:
- a first mode for rubbing a second region of an occipital region by moving the second contact unit in a state in which the first contact unit contacts a first region of the occipital region of the person with the first contact unit being fixed at a first position; and
- a second mode for rubbing the first region of the occipital region by moving the first contact unit in a state in which the second contact unit contacts the second region of the occipital region with the second contact unit being fixed at a second position.

2. The automatic head care apparatus according to claim 1, wherein the plurality of modes include a third mode for fixing the first contact unit at the first position, and for fixing the second contact unit at the second position.

3. The automatic head care apparatus according to claim 1, wherein the control unit controls the first driving unit and the second driving unit so that height of the first contact unit fixed at the first position is equal to height of the second contact unit fixed at the second position.

4. The automatic head care apparatus according to claim 1, wherein the first contact unit is provided on both sides of the second contact unit so as to sandwich the second contact unit.

5. The automatic head care apparatus according to claim 4, wherein the control unit controls the first driving unit and the second driving unit so that a first contact region of the occipital region which is rubbed by the first contact unit in the second mode, partially overlaps a second contact region of the occipital region which is rubbed by the second contact unit in the first mode.

6. The automatic head care apparatus according to claim 4, wherein the second contact unit is rotated by the second driving unit which is controlled by the control unit.

7. The automatic head care apparatus according to claim 1, which further comprises:
- a nozzle for jetting liquid of at least one of water and washing solution toward the person's head; and
- a liquid supply unit for supplying the liquid to the nozzle,
- wherein the control unit makes the nozzle jet the liquid toward the occipital region and makes at least one of the first contact unit and the second contact unit move, so as to wash the person's head.

8. The automatic head care apparatus according to claim 1, wherein one of the first contact unit and the second contact unit comprises:
- a plurality of contacts;
- a support piece to which the plurality of contacts are connected through elastic pieces; and
- a load-receiving piece which is provided below the plurality of contacts at a distance therefrom.

9. The automatic head care apparatus according to claim 1, wherein the control unit controls at least one of the first driving unit and the second driving unit so that one of the first contact unit and the second contact unit vibrates in a direction of getting near and away with respect to the occipital region.

10. The automatic head care apparatus according to claim 2, which further comprises a swing arm that can swing around in a direction of front-and-back of the person's head, that can push-rotate in a direction of moving closer to and away from the head, and that has a contact able to contact the head,
- wherein the control unit controls the first driving unit and the second driving unit in the third mode, in a state in which the swing arm is moving.

11. An automatic head care method for caring a person's head automatically, which cares the person's head in a plurality of modes, including:
- a first mode for rubbing a second region of an occipital region by moving a second contact unit in a state in which a first contact unit contacts a first region of the occipital region of the person with the first contact unit being fixed at a first position; and
- a second mode for rubbing the first region of the occipital region by moving the first contact unit in a state in which the second contact unit contacts the second region of the occipital region with the second contact unit being fixed at a second position.

12. The automatic head care method according to claim 11, wherein the plurality of modes include a third mode for fixing the first contact unit at the first position, and for fixing the second contact unit at the second position.

13. The automatic head care method according to claim 11, which makes height of the first contact unit fixed at the first position equal to height of the second contact unit fixed at the second position.

14. The automatic head care method according to claim 11, wherein a first contact region of the occipital region which is rubbed by the first contact unit in the second mode, partially overlaps a second contact region of the occipital region which is rubbed by the second contact unit in the first mode.

15. The automatic head care method according to claim 11, which washes the person's head, by making a nozzle for jetting liquid of at least one of water and washing solution toward the person's head, jet the liquid toward the occipital region, and by moving at least one of the first contact unit and the second contact unit.

16. The automatic head care method according to claim 11, which vibrates one of the first contact unit and the second contact unit in a direction of getting near and away with respect to the occipital region.

17. The automatic head care method according to claim 12, wherein an apparatus which comprises the first contact unit and the second contact unit, further comprises a swing arm that can swing around in a direction of front-and-back of the person's head, that can push-rotate in a direction of moving closer to and away from the head, and that has a contact able to contact the head, wherein an operational mode of the first contact unit and the second contact unit is set to be the third mode, in a state in which the swing arm is moving.

* * * * *